US009440454B2

(12) United States Patent
Kawai

(10) Patent No.: US 9,440,454 B2
(45) Date of Patent: Sep. 13, 2016

(54) PRINTER

(71) Applicant: Brother Kogyo Kabushiki Kaisha, Nagoya-shi, Aichi-ken (JP)

(72) Inventor: Junya Kawai, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/003,897

(22) Filed: Jan. 22, 2016

(65) Prior Publication Data

US 2016/0214400 A1 Jul. 28, 2016

(30) Foreign Application Priority Data

Jan. 23, 2015 (JP) ..... 2015-011070

(51) Int. Cl.
*B41J 29/393* (2006.01)
*B41J 3/407* (2006.01)
*B41J 15/04* (2006.01)

(52) U.S. Cl.
CPC ..... *B41J 3/4075* (2013.01); *B41J 15/04* (2013.01)

(58) Field of Classification Search
CPC .. B41J 11/0095; B41J 13/103; B41J 11/005; B41J 13/0018; B41J 2/04508; B41J 2/07; B41J 2/125; B41J 2/14153
See application file for complete search history.

(56) References Cited

U.S. PATENT DOCUMENTS

| | | | | |
|---|---|---|---|---|
| 8,857,973 | B2 | 10/2014 | Wada | |
| 9,193,192 | B1 * | 11/2015 | Regelsberger | B41J 15/16 |
| 9,278,559 | B1 * | 3/2016 | Regelsberger | B41J 15/16 |
| 9,333,775 | B2 * | 5/2016 | Kozuma | B65H 23/0326 |
| 2012/0050438 | A1 | 3/2012 | Wada | |

FOREIGN PATENT DOCUMENTS

| | | | |
|---|---|---|---|
| JP | 2012-046307 | A | 3/2012 |
| JP | 2012-126517 | A | 7/2012 |
| JP | 2014-069328 | A | 4/2014 |

* cited by examiner

*Primary Examiner* — Lamson Nguyen
(74) *Attorney, Agent, or Firm* — Banner & Witcoff, Ltd.

(57) ABSTRACT

The disclosure discloses a printer including a storage part, a feeding roller, a printing head, a core driving device, and a controller. The controller is configured to execute a feeding process, a printing process, a taking-up process, and a torque correction process. In the feeding process, the feeding roller is driven to feed the print-receiving tape fed out from the print-receiving tape roll. In the printing process the printing head is controlled to form a desired print, thereby a printed tape is formed. In the taking-up process, the core driving device is driven to sequentially take up the printed tape around an outer circumferential portion of a second core. In the torque correction process, a drive torque of the core driving device is corrected from a first drive torque to a second drive torque corresponding to a tape width of the print-receiving tape.

14 Claims, 17 Drawing Sheets

INTENDED ROLL FORM AT APPROPRIATE TENSION

ROLL FORM AT LARGE TENSION

ROLL FORM AT LARGE TENSION

FIG. 10

| | | CORE OUTER DIAMETER [mm] | | | | | |
|---|---|---|---|---|---|---|---|
| | | 75 | | | 30 | | |
| TAPE WIDTH [mm] | TAKE-UP TAPE LENGTH [m] | TAPE TYPE | | | | | |
| | | OPP | PET | FAB | OPP | PET | FAB |
| 15 | 0-4 | Δ40 | Δ40 | Δ45 | Δ50 | Δ50 | Δ55 |
| | 5-9 | Δ40 | Δ40 | Δ45 | Δ50 | Δ50 | Δ55 |
| | 10-14 | Δ35 | Δ35 | Δ40 | Δ45 | Δ45 | Δ50 |
| | 15-19 | Δ35 | Δ35 | Δ40 | Δ45 | Δ45 | Δ50 |
| | 20-24 | Δ30 | Δ30 | Δ35 | Δ40 | Δ40 | Δ45 |
| | 25-30 | Δ30 | Δ30 | Δ35 | Δ40 | Δ40 | Δ45 |
| 38 | 0-4 | Δ20 | Δ20 | Δ25 | Δ30 | Δ30 | Δ35 |
| | 5-9 | Δ20 | Δ20 | Δ25 | Δ30 | Δ30 | Δ35 |
| | 10-14 | Δ15 | Δ15 | Δ20 | Δ25 | Δ25 | Δ30 |
| | 15-19 | Δ15 | Δ15 | Δ20 | Δ25 | Δ25 | Δ30 |
| | 20-24 | Δ10 | Δ10 | Δ15 | Δ20 | Δ20 | Δ25 |
| | 25-30 | Δ10 | Δ10 | Δ15 | Δ20 | Δ20 | Δ25 |
| 50 | 0-4 | Δ15 | Δ15 | Δ20 | Δ20 | Δ20 | Δ25 |
| | 5-9 | Δ15 | Δ15 | Δ20 | Δ20 | Δ20 | Δ25 |
| | 10-14 | Δ10 | Δ10 | Δ15 | Δ15 | Δ15 | Δ20 |
| | 15-19 | Δ10 | Δ10 | Δ15 | Δ15 | Δ15 | Δ20 |
| | 20-24 | Δ5 | Δ5 | Δ10 | Δ10 | Δ10 | Δ15 |
| | 25-30 | Δ5 | Δ5 | Δ10 | Δ10 | Δ10 | Δ15 |

FIG. 14

| | CORE OUTER DIAMETER [mm] | |
|---|---|---|
| TAPE WIDTH [mm] | 75 | 30 |
| 15 | Δ45 | Δ55 |
| 38 | Δ15 | Δ25 |
| 50 | Δ10 | Δ20 |

FIG. 15

| TAPE WIDTH [mm] | CORRECTION AMOUNT [%] |
|---|---|
| 15 | Δ45 |
| 38 | Δ15 |
| 50 | Δ10 |

FIG. 16

CALCULATION FORMULA PARAMETER

TAPE WIDTH: 15mm = △45 (%)
: 38mm = △15 (%)
: 50mm = △10 (%)

— SUBTRACT

TAKE-UP TAPE LENGTH:
CURRENT TAKE-UP TAPE LENGTH (m) × 0.5(%)

+ ADD

TAPE TYPE : OPP = 0 (%)
: PET = 0 (%)
: FAB = △5 (%)

+ ADD

CORE OUTER DIAMETER: 75mm = 0 (%)
: 30mm = △10 (%)

(CALCULATION EXAMPLE)

TAPE WIDTH : 15mm
TAPE-UP TAPE LENGTH : 20m
TAPE TYPE : FAB
CORE OUTER DIAMETER : 30mm

△45 - (20 × 0.5) + △5 + △10 = △50 (%)

CORRECTION AMOUNT △50 (%)

INTENDED ROLL FORM AT APPROPRIATE TENSION

ROLL FORM AT SMALL TENSION

ROLL FORM AT SMALL TENSION

PRINTER

CROSS-REFERENCE TO RELATED APPLICATIONS

This application claims priority from JP 2015-011070, filed Jan. 23, 2015, the contents of which are hereby incorporated by reference.

BACKGROUND

1. Field

The present disclosure relates to a printer forming a desired print on a print-receiving tape.

2. Description of the Related Art

A printer is known that forms a desired print on a print-receiving tape. This printer of prior art includes a feeding roller and a printing head. The print-receiving tape is fed out from a print-receiving tape roll and is fed by the feeding roller. On the print-receiving tape being fed, the printing head forms a desired print at a desired printing speed to turn the print-receiving tape into a printed tape. The printed tape is then sequentially taken up around an outer circumferential portion of a core driven by a core driving device into a roll shape.

The feeding/taking-up behavior as described above causes forces to act on the print-receiving tape both at the time of contact and feeding by the feeding roller and at the time of taking-up by the core. During feeding/taking-up as described above, a tension of the printed tape may become excessively large or excessively small for some reason.

For example, if a tape width of the print-receiving tape is relatively narrow, the printed tape wound into a roll shape is in close contact with itself in a small area and is therefore strongly tightened and subjected to an excessively large tension, and a displacement in a width direction of the printed tape (so-called telescopic roll deformation) tends to occur so as to release the force within a printed tape roll.

For example, if a tape width of the print-receiving tape is relatively wide, conversely, the printed tape wound into a roll shape is in close contact with itself in a large area and is therefore subjected to an excessively small tension, and a gap (so-called floating tape) or a sag (so-called gear-shaped roll deformation) tends to occur in a laminate structure of the printed tape in the printed tape roll.

SUMMARY

It is an object of the present disclosure to provide a printer capable of preventing occurrence of a displacement in a width direction of a printed tape in a printed tape roll due to an excessively large tension and a gap or a sag in a laminate structure of the printed tape in the printed tape roll due to an excessively small tension, so as to prevent a deterioration in roll quality.

In order to achieve the above-described object, according to an aspect of the present application, there is provided a printer comprising a storage part configured to store a print-receiving tape roll with a print-receiving tape wound around an outer circumferential portion of a first core, a feeding roller, a printing head disposed facing the feeding roller, a core driving device, and a controller, the controller being configured to execute a feeding process for driving the feeding roller to contact and feed the print-receiving tape fed out from the print-receiving tape roll stored in the storage part, a printing process for controlling the printing head to form a desired print at a desired printing speed on the print-receiving tape fed by the feeding process, thereby forming a printed tape, a taking-up process for driving the core driving device to sequentially take up the printed tape around an outer circumferential portion of a second core into a roll shape, and a torque correction process for correcting a drive torque of the core driving device from a first drive torque determined as standard value in advance to a second drive torque corresponding to a tape width of the print-receiving tape.

A printer of the present disclosure includes the feeding roller and the printing head. The print-receiving tape is fed out from the first core of the print-receiving tape roll stored in the storage part and is fed by the feeding roller. On the print-receiving tape being fed, the printing head forms a desired print at a desired printing speed to turn the print-receiving tape into the printed tape. The printed tape is then sequentially taken up around the outer circumferential side of the second core (driven by the core driving device) into a roll shape (=formation of a printed tape roll). The feeding/taking-up behavior as described above causes forces to act on the print-receiving tape both at the time of contact and feeding by the feeding roller and at the time of taking-up by the second core. In the present disclosure, the drive torque of the core driving device is normally controlled to a desired first drive torque that is a standard value determined appropriately in advance (corresponding to a theoretical value acquired without giving particular consideration to occurrence of a displacement in the width direction of the printed tape due to an excessively large tension and occurrence of a gap or a sag in a laminate structure of the printed tape due to an excessively small tension described later) so as to smoothly feed and take up the tape while keeping the balance between these two forces.

However, for example, if a tape width of the print-receiving tape is relatively narrow, the printed tape wound into a roll shape is in close contact with itself in a small area and is therefore strongly tightened and subjected to an excessively large tension, and a displacement in a width direction of the printed tape (so-called telescopic roll deformation) tends to occur so as to release the force within a printed tape roll. For example, if a tape width of the print-receiving tape is relatively wide, conversely, the printed tape wound into a roll shape is in close contact with itself in a large area and is therefore subjected to an excessively small tension, and a gap (so-called floating tape) or a sag (so-called gear-shaped roll deformation) tends to occur in a laminate structure of the printed tape in the printed tape roll.

Therefore, in the present disclosure, a controller executes a torque correction process. In this torque correction process, the drive torque of the core driving device is corrected from the first drive torque to the second drive torque in accordance with the tape width. If an excessively large tension of the printed tape may be generated as described above, the torque can be set to the second drive torque smaller than the first drive torque to prevent the tension from becoming excessively large. As a result, the displacement in the width direction of the printed tape described above can be prevented so as to form the printed tape roll in a correct form. If an excessively small tension of the printed tape may be generated as described above, the torque can be set to the second drive torque larger than the first drive torque to prevent the tension from becoming excessively small. As a result, the gap or sag in the printed tape roll described above can be prevented so as to form the printed tape roll in a correct form.

BRIEF DESCRIPTION OF DRAWINGS

FIG. 10 is an exemplary correction amount table indicative of a correction amount of a first voltage command value.

FIG. 14 is an exemplary correction amount table indicative of a correction amount of the first voltage command value in a modification example of a simplified correction amount setting mode.

FIG. 15 is an exemplary correction amount table indicative of a correction amount of the first voltage command value in a modification example of a simplified correction amount setting mode.

FIG. 16 is an explanatory diagram of an example of a correction amount calculation technique based on calculation using a calculation formula parameter in a modification example for calculating a correction amount without using a correction amount table.

DETAILED DESCRIPTION OF THE PREFERRED EMBODIMENTS

Figure 1:
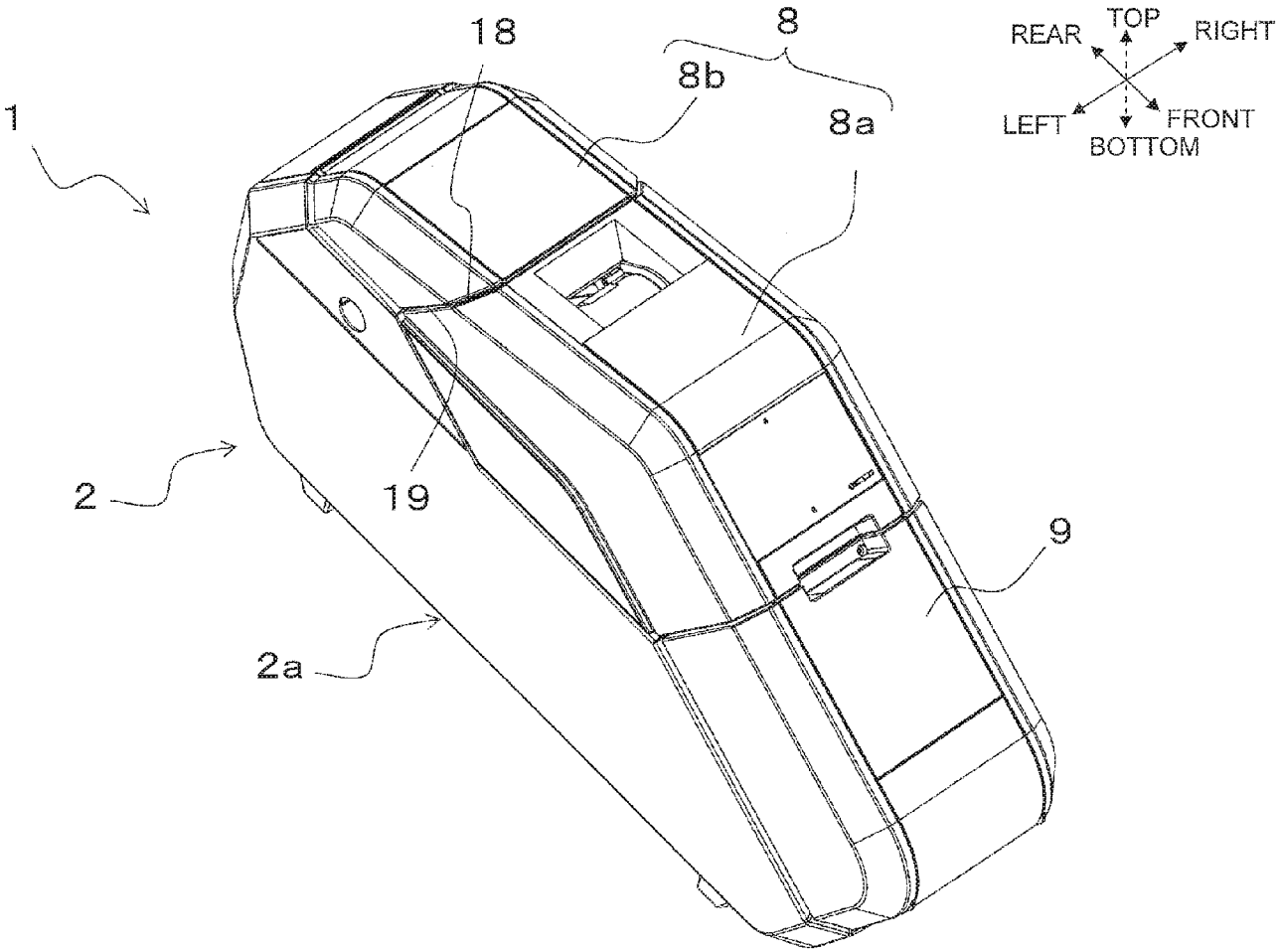
FIG. 1 is a perspective view of an exterior appearance of a printer of a first embodiment of the present disclosure.

An embodiment of the present disclosure will now be described with reference to the drawings. If "front," "rear," "left," "right," "top," and "bottom" are noted in the drawings, "front," "rear," "left," "right," "top (above)," and "bottom (under)" in the description indicate the noted directions.

<General Configuration of Printer>

A general configuration of a printer of this embodiment will be described with reference to FIGS. 1 to 4.

<Housing>

As shown in FIGS. 1 to 4, a printer 1 of this embodiment has a housing 2 making up an outer contour of the printer. The housing 2 includes a housing main body 2*a*, a rear openable potion 8, and a front openable cover 9.

The housing main body 2*a* includes therein a first storage part 3 disposed to the rear side as well as a second storage part 5 and a third storage part 4 disposed to the front side.

The rear openable portion 8 is connected to an upper portion on the rear side of the housing main body 2*a* in an openable manner. The rear openable portion 8 can rotate to open and close the top of the first storage part 3. The rear openable portion 8 is made up of a first openable cover 8*a* and a second openable cover 8*b*.

The first openable cover 8*a* can rotate around a rotation axis K1 located at the upper portion on the rear side of the housing main body 2*a* to open and close the top on the front side of the first storage part 3. Specifically, the first openable cover 8*a* can rotate from a closing position covering the top on the front side of the first storage part 3 (a state of FIGS. 1 and 2) to an opening position exposing the top on the front side of the first storage part 3 (a state of FIGS. 3 and 4).

A head holder 10 including a printing head 11 (described later in detail) is disposed inside the first openable cover 8*a*. The first openable cover 8*a* can rotate around the rotation axis K1 to move the printing head 11 away from/close to a feeding roller 12 (described later in detail) disposed to the housing main body 2*a*. Specifically, the first openable cover 8*a* can rotate from the closing position at which the printing head 11 is located close to the feeding roller 12 (the state of FIGS. 1 and 2) to the opening position at which the printing head 11 is located away from the feeding roller 12 (the state of FIGS. 3 and 4).

The second openable cover 8*b* is disposed to the rear side relative to the first openable cover 8*a* and can rotate around a rotation axis K2 located at an upper end portion on the rear side of the housing main body 2*a* to open and close the top on the rear side of the first storage part 3 separately from opening/closing of the first openable cover 8*a*. Specifically, the second openable cover 8*b* can rotate from a closing position covering the top on the rear side of the first storage part 3 (the state of FIGS. 1 and 2) to an opening position exposing the top on the rear side of the first storage part 3 (the state of FIGS. 3 and 4).

When both the first and second openable covers 8*a*, 8*b* are in the closing state, an outer circumferential portion 18 of the first openable cover 8*a* is substantially in contact with an edge 19 of the second openable cover 8*b* to substantially entirely cover the top of the first storage part 3.

The front openable cover 9 is connected to an upper portion on the front side of the housing main body 2*a* in an openable manner. The front openable cover 9 can rotate around a rotation axis K3 located at an upper end portion on the front side of the housing main body 2*a* to open and close the top of the third storage part 4. Specifically, the front openable cover 9 can rotate from a closing position covering the top of the third storage part 4 (the state of FIGS. 1 and 2) to an opening position exposing the top of the third storage part 4 (the state of FIGS. 3 and 4).

<Adhesive Tape Roll and Periphery Thereof>

Figure 2:
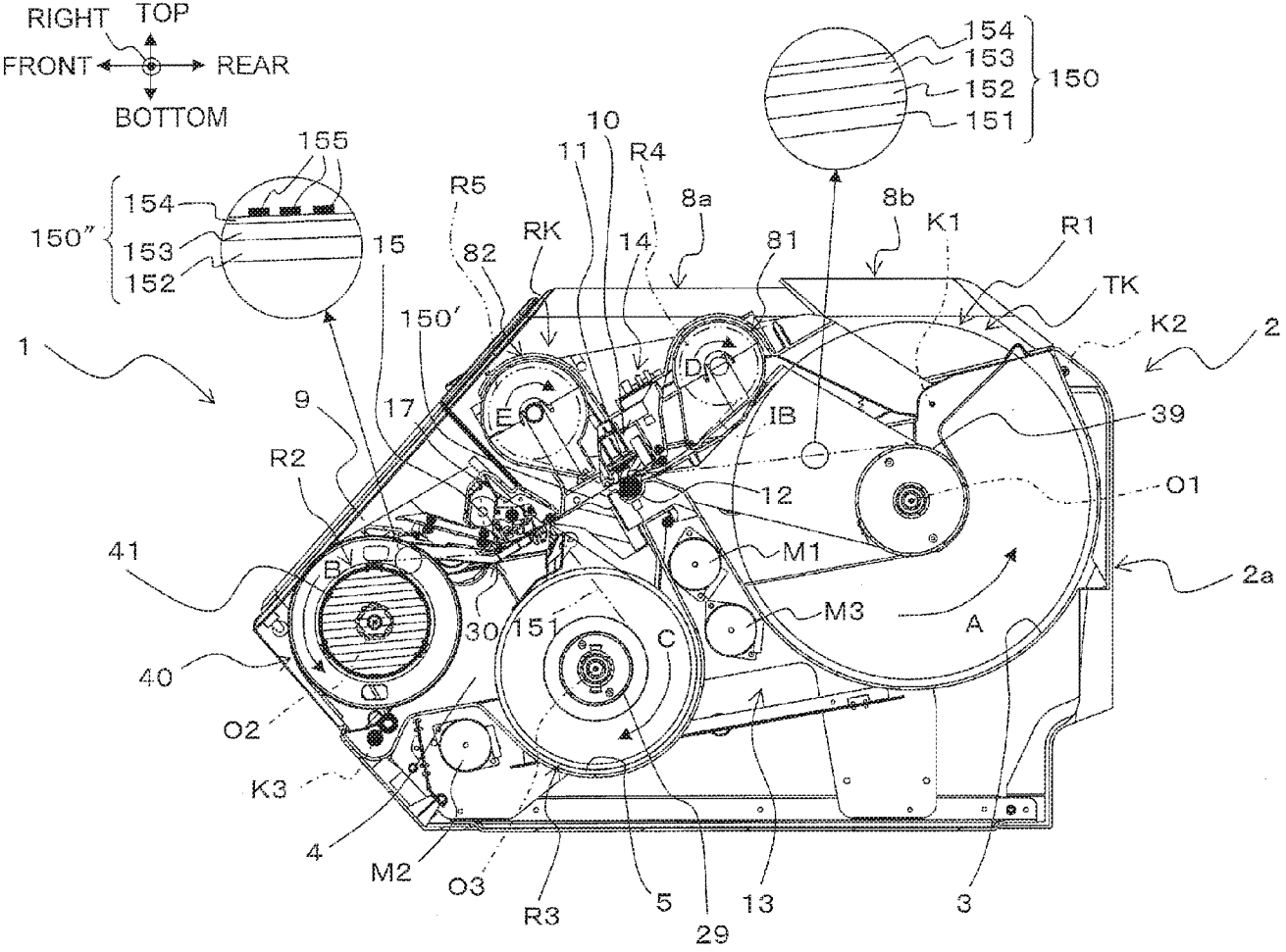
FIG. 2 is a side cross-sectional view of an internal structure of the printer.
Figure 3:
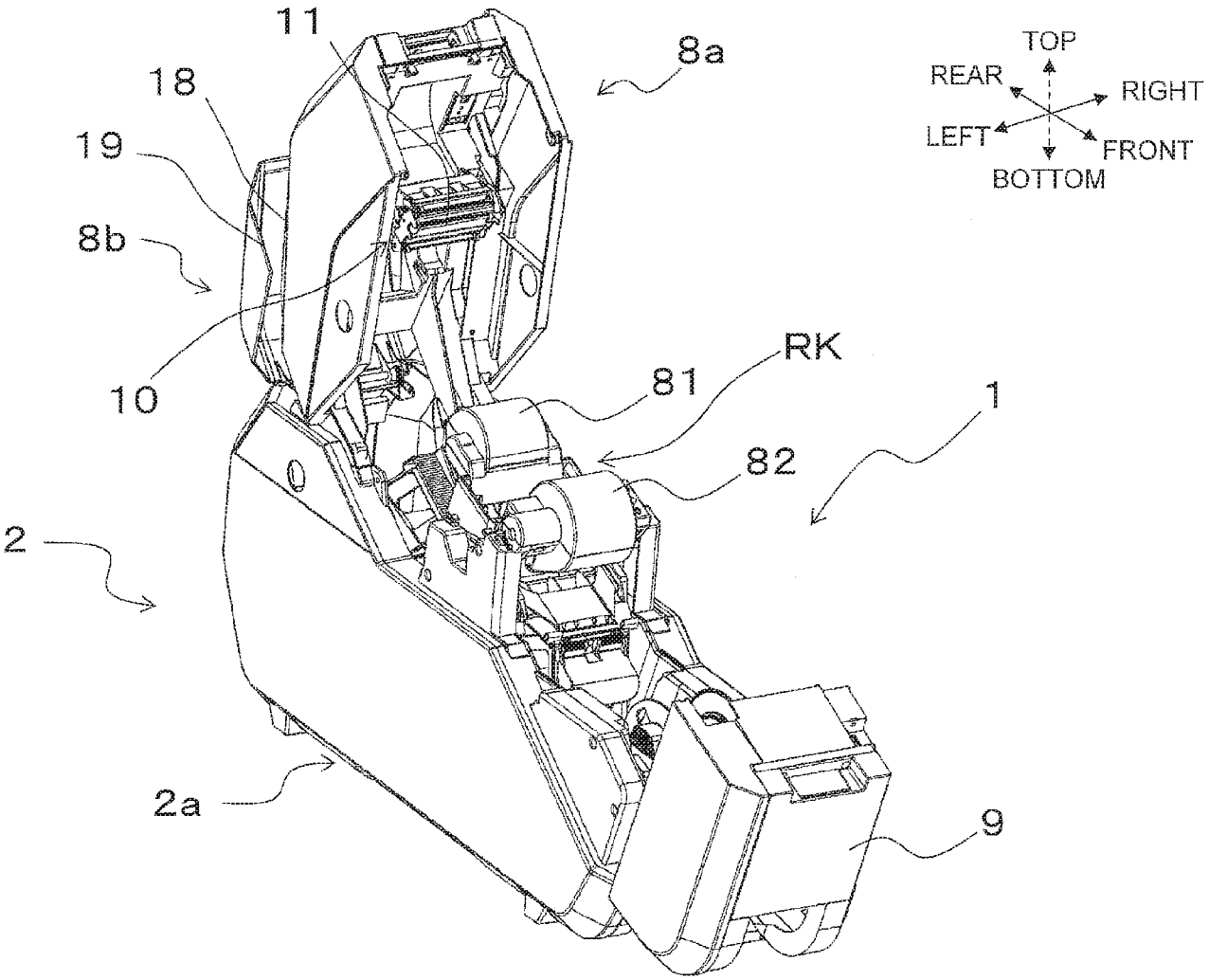
FIG. 3 is a perspective view of the exterior appearance of the printer with a first openable cover, a second openable cover, and a front openable cover opened.
Figure 4:
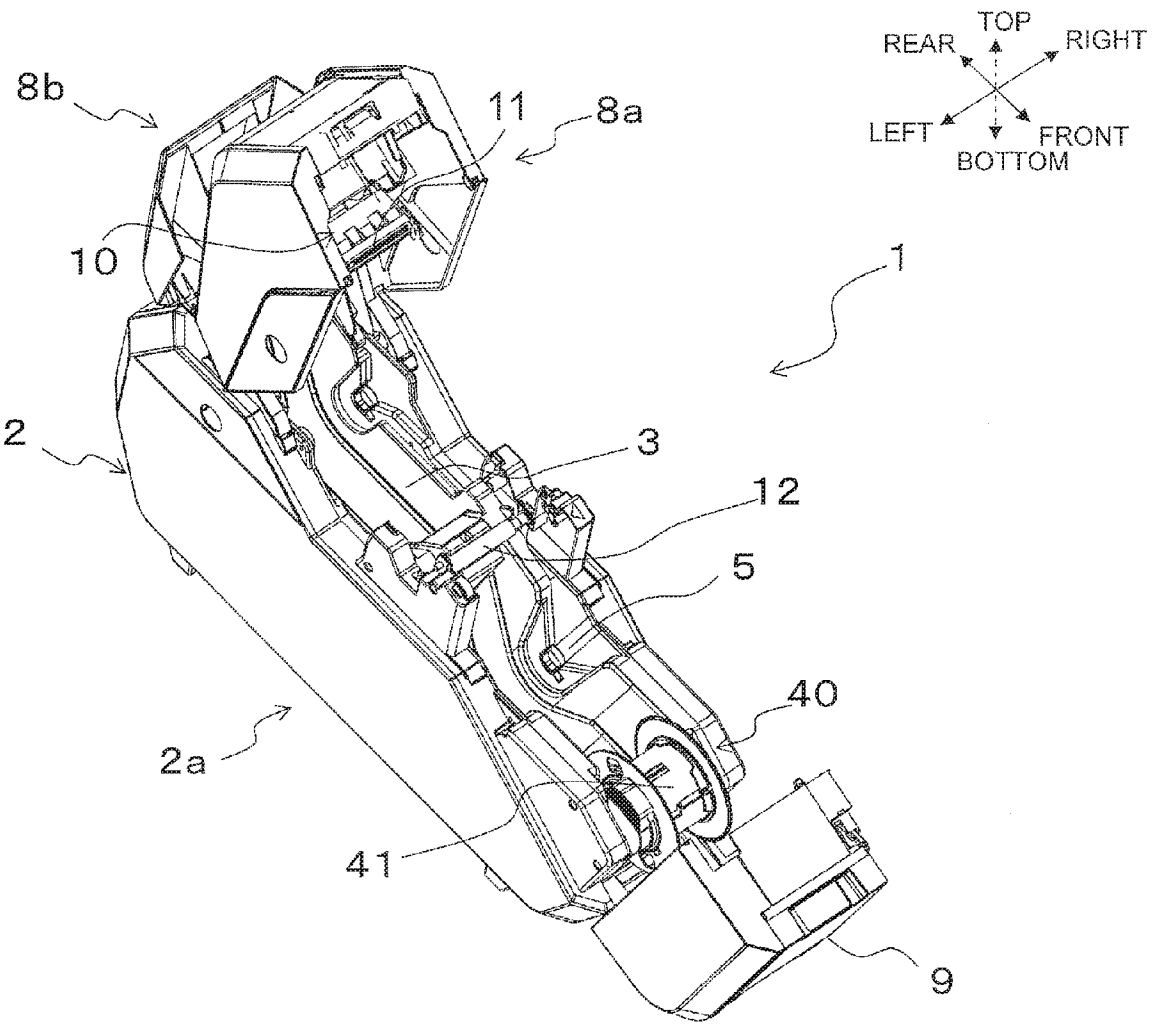
FIG. 4 is a perspective view of the printer with the first openable cover, the second openable cover, and the front openable cover opened and with a tape cartridge and an ink ribbon cartridge removed.
Figure 5:
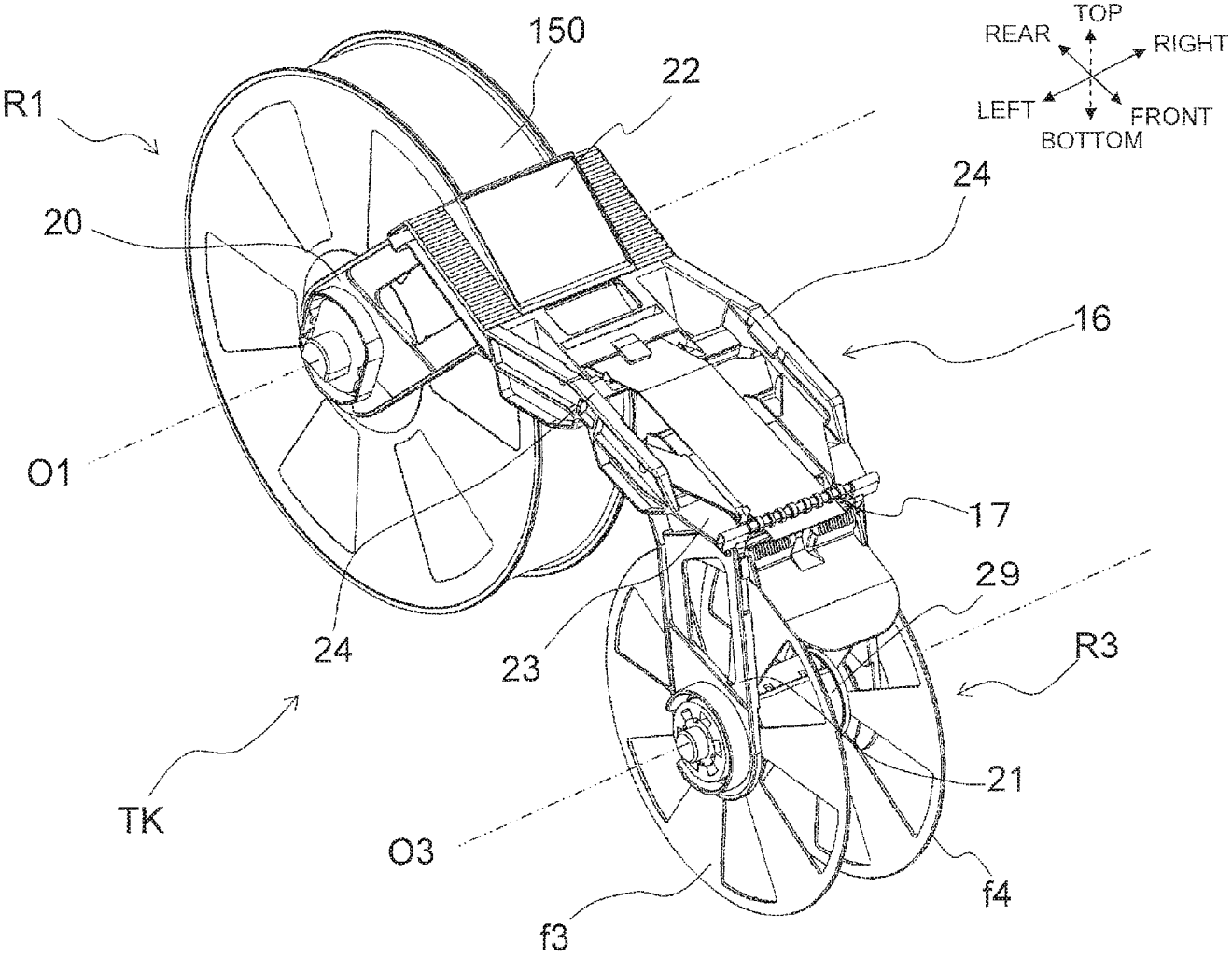
FIG. 5 is a perspective view of an overall configuration of the tape cartridge.

As shown in FIGS. 2 to 4, a tape cartridge TK is detachably mounted on the housing main body 2*a* at a first predetermined position 13 located under the front openable cover 9 in the closing state. The tape cartridge TK includes an adhesive tape roll R1 wound and formed around an axis O1. FIG. 5 shows a detailed structure of the tape cartridge TK.

As shown in FIG. 5, the tape cartridge TK includes the above described adhesive tape roll R1 and a coupling arm 16. The coupling arm 16 includes a pair of left and right first bracket portions 20, 20 disposed to the rear side, and a pair of left and right second bracket portions 21, 21 disposed to the front side.

The first bracket portions 20, 20 sandwich the adhesive tape roll R1 from both the left and right sides along the axis O1, and rotatably hold the adhesive tape roll R1 around a core 39 (see FIG. 2) while the tape cartridge TK is mounted on the housing main body 2*a*. These first bracket portions 20, 20 are connected at upper end portions through a first connecting portion 22 extended substantially along the left-right direction while avoiding interference with the outer diameter of the adhesive tape roll R1.

The adhesive tape roll R1 is freely rotatable when the tape cartridge TK is mounted inside the housing main body 2*a*. In the adhesive tape roll R1, an adhesive tape 150 to be fed out and consumed is wound around an outer circumferential portion of the above described core 39 in advance.

As shown in FIG. 2, when the tape cartridge TK is mounted, the adhesive tape roll R1 is received from above and stored in the first storage part 3 with the axis O1 of winding of the adhesive tape 150 defined in the left-right direction. While being stored in the first storage part 3 (while the tape cartridge TK is mounted), the adhesive tape roll R1 rotates in a predetermined rotation direction (direction A in FIG. 2) in the first storage part 3 to feed out the adhesive tape 150.

In the case described in this embodiment, the above described adhesive tape 150 used is a print-receiving tape having adhesiveness. Therefore, the adhesive tape 150 has a print-receiving layer 154, a base layer 153, an adhesive layer 152, and a separation material layer 151 laminated in this order in a thickness direction from one side (the top side in a partially enlarged view of FIG. 2) toward the other side (the bottom side in the partially enlarged view of FIG. 2). The print-receiving layer 154 is a layer on which a desired print portion 155 (see a partially enlarged view of FIG. 2) is formed through heat transfer printing with ink by the above described printing head 11. The adhesive layer 152 is a layer for affixing the base layer 153 to a suitable adherend (not shown). The separation material layer 151 is a layer covering the adhesive layer 152.

<Feeding Roller and Printing Head>

As shown in FIGS. 2 to 4, the above described feeding roller 12 is disposed to a top middle side of the first and second storage parts 3, 5 in the housing main body 2*a*. The feeding roller 12 is driven via a gear mechanism (not shown) by a first motor M1 that is, for example, a pulse motor, disposed inside the housing main body 2*a*, and thereby contacts the adhesive tape 150 fed out from the adhesive tape roll R1 stored in the first storage part 3 and feeds the adhesive tape 150 in a posture with a width direction (tape width direction) defined as the left-right direction.

As described above, the above described head holder 10 disposed to the first openable cover 8*a* includes the above described printing head 11. The printing head 11 can be moved away from/close to the feeding roller 12 by rotating the first openable cover 8*a* around the rotation axis K1 as described above. In particular, when the first openable cover 8*a* is in the closing state, the printing head 11 is located close to the feeding roller 12, and when the first openable cover 8*a* is in the opening state, the printing head 11 is located away from the feeding roller 12. The printing head 11 is disposed to the head holder 10 at a position facing the top of the feeding roller 12 in the closing state of the first openable cover 8*a*, so as to sandwich and support the adhesive tape 150 fed by the feeding roller 12 in cooperation with the feeding roller 12. Therefore, if the first openable cover 8*a* is in the closing state, the printing head 11 and the feeding roller 12 are arranged facing each other in the top-bottom direction. On the above described print-receiving layer 154 of the adhesive tape 150 sandwiched with the feeding roller 12, the printing head 11 forms a desired print (the above described print portion 155) at a desired printing speed set in advance (e.g., a printing speed synchronized with a feeding speed (a tape feeding speed) of the adhesive tape 150) with a known technique by using an ink ribbon IB of an ink ribbon cartridge RK described later, thereby turning the adhesive tape 150 into a printed adhesive tape 150'.

<Ink Ribbon Cartridge>

Figure 6:
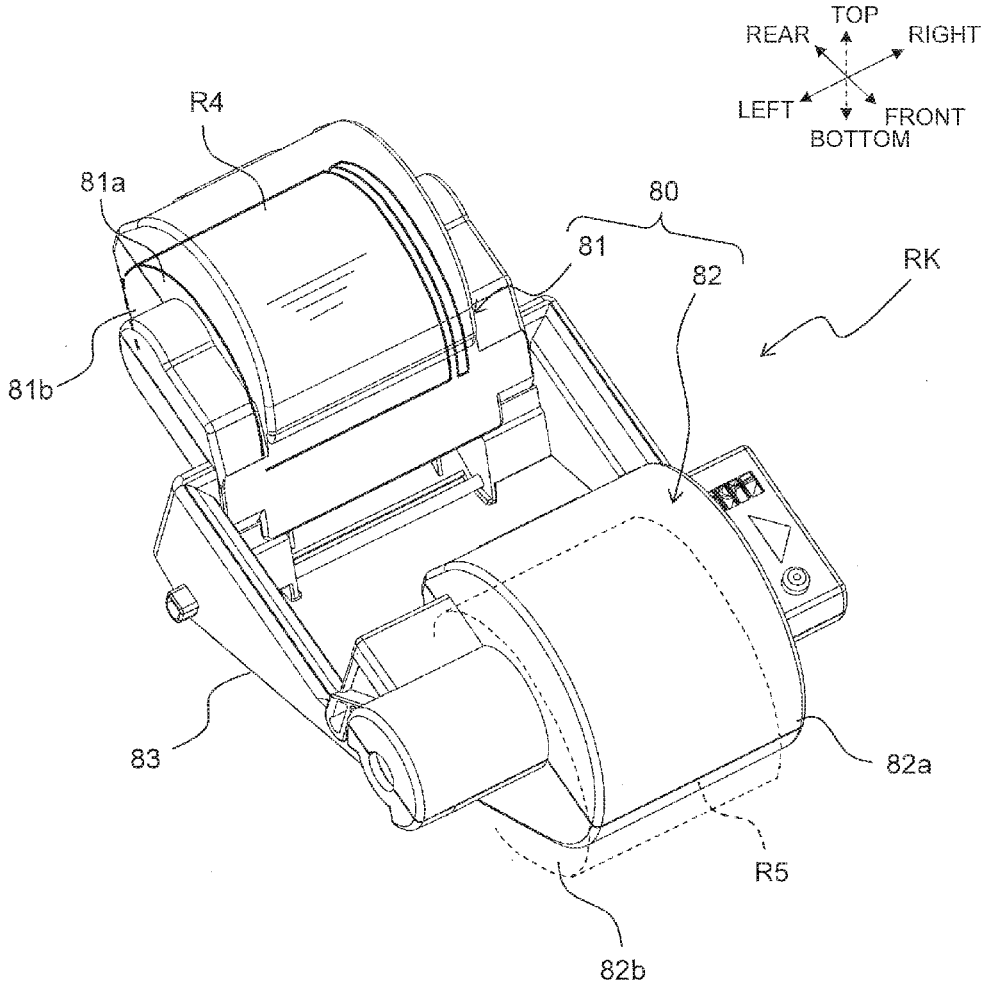
FIG. 6 is a perspective view of an overall configuration of the ink ribbon cartridge.

As shown in FIGS. 2 and 3, the ink ribbon cartridge RK is detachably mounted on a second predetermined position 14 under the first openable cover 8*a* and above the tape cartridge TK in the closing state of the housing main body 2*a*. FIG. 6 shows a detailed structure of the ink ribbon cartridge RK.

As shown in FIGS. 2, 3, and 6, the ink ribbon cartridge RK includes a cartridge housing 80, a ribbon feed-out roll R4 that is the unused wound ink ribbon IB capable of being fed out for print formation by the printing head 11, and a ribbon take-up roll R5. The cartridge housing 80 has a feed-out roll storage part 81 on the rear side, a take-up roll storage part 82 on the front side, and a coupling portion 83. The coupling portion 83 couples the take-up roll storage part 82 and the feed-out roll storage part 81 such that the ink ribbon IB fed out from the ribbon feed-out roll R4 is exposed outside the cartridge housing 80.

The feed-out roll storage part 81 is formed by combining a substantially half-cylindrical upper portion 81*a* with a lower portion 81*b*. The ribbon feed-out roll R4 is freely rotatably supported in the feed-out roll storage part 81 and rotates in a predetermined rotation direction (direction D of FIG. 2) in a mounted state of the ink ribbon cartridge RK so as to feed out the ink ribbon IB.

The take-up roll storage part 82 is formed by combining a substantially half-cylindrical upper portion 82*a* with a lower portion 82*b*. The ribbon take-up roll R5 is freely rotatably supported in the take-up roll storage part 82 and rotates in a predetermined rotation direction (direction E of FIG. 2) in a mounted state of the ink ribbon cartridge RK so as to take up the used ink ribbon IB after print formation.

Therefore, the ink ribbon IB fed out from the ribbon feed-out roll R4 is disposed closer to the printing head 11 on the adhesive tape 150 sandwiched between the printing head 11 and the feeding roller 12 and comes into contact with the bottom of the printing head 11. The ink of the ink ribbon IB is heated by the printing head 11 and transferred to the print-receiving layer 154 of the adhesive tape 150, and the used ink ribbon IB is then taken up by the ribbon take-up roll R5.

<Separation Material Roll and Periphery Thereof>

As shown in FIGS. 2 and 5, the above described coupling arm 16 of the tape cartridge TK includes a peeling portion 17 including a substantially horizontal slit shape, for example. The peeling portion 17 is a portion peeling off the separation material layer 151 from the printed adhesive tape 150' fed out from the adhesive tape roll R1 toward the front side. By peeling off the separation material layer 151 by the peeling portion 17, the printed adhesive tape 150' having a print formed as described above is divided into the separation material layer 151 and a printed adhesive tape 150" made up of the print-receiving layer 154, the base layer 153, and the adhesive layer 152 other than the separation material layer 151.

The tape cartridge TK has a separation material roll R3 formed into a roll shape by sequentially winding the separation material layer 151 peeled off as described above around an outer circumferential portion of a core 29. In particular, when the tape cartridge TK is mounted, the separation material roll R3 is received from above and stored in the above described second storage part 5 with an axis O3 of winding of the printed adhesive tape 150" defined in the left-right direction. While being stored in the second storage part 5 (while the tape cartridge TK is mounted), the core 29 is driven via the gear mechanism (not shown) by a third motor M3 disposed inside the housing main body 2*a* to rotate in a predetermined rotation direction (direction C of FIG. 2) in the second storage part 5, thereby taking up the separation material layer 151.

In this case, the above described second bracket portions 21, 21 of the tape cartridge TK sandwich the separation material roll R3 from both the left and right sides along the axis O3, and rotatably hold the core 29 (in other words, the separation material roll R3) around the axis O3 while the tape cartridge TK is mounted on the housing main body 2*a*. These second bracket portions 21, 21 are connected at upper end portions through a second connecting portion 23 extended substantially along the left-right direction. The above described first bracket portions 20, 20 and the first connecting portion 22 on the rear side of the tape cartridge TK are connected to the second bracket portions 21, 21 and the second connecting portion 23 on the front side by a pair of left and right roll-coupling beam portions 24, 24.

It is noted that FIG. 5 shows the state before the separation material roll R3 is formed by winding the separation material layer 151 around the outer circumferential portion of the core 29 (the case of the unused tape cartridge TK). Therefore, FIG. 5 shows substantially circular roll flange portions f3, f4 disposed to sandwich the both sides of the separation material layer 151 in the tape width direction and includes reference numeral "R3" added for convenience at a position where the separation material roll R3 is formed.

<Printed Adhesive Tape Roll and Periphery Thereof>

On the other hand, as shown in FIGS. 2 and 4, the above described third storage part 4 receives from above a take-up mechanism 40 including a core 41 sequentially taking up the printed adhesive tape 150" on an outer circumferential portion into a roll shape. The take-up mechanism 40 is stored with an axis O2 of winding of the printed adhesive tape 150" defined in the left-right direction such that the above described core 41 is rotatably supported around the axis O2. While the take-up mechanism 40 is stored in the third storage part 4, the core 41 is driven via the gear mechanism (not shown) by a second motor M2 disposed inside the housing main body 2*a* to rotate in a predetermined rotation direction (direction B of FIG. 2) in the third storage part 4, thereby sequentially taking and piling up the printed adhesive tape 150" around the outer circumferential portion of the core 41. As a result, the printed adhesive tape 150" is sequentially wound around the outer circumferential portion of the core 41 into a roll shape, thereby forming a printed adhesive tape roll R2.

<Cutter Mechanism>

As shown in FIG. 2, a cutter mechanism 30 is disposed downstream of the printing head 11 and upstream of the printed adhesive tape roll R2 along the feeding direction of the adhesive tape 150 (tape feeding direction).

Although not shown in detail, the cutter mechanism 30 has a movable blade, and a running body capable of supporting the movable blade and running in the tape width direction (in other words, left-right direction). The running body is driven by a cutter motor MC (see FIG. 7 described later) to run to move the movable blade in the tape width direction so as to cut the above described printed adhesive tape 150" in the tape width direction.

<General Operation of Printer>

A general operation of the printer 1 having the above described configuration will be described.

When the tape cartridge TK is mounted on the first predetermined position 13, the adhesive tape roll R1 is stored in the first storage part 3, and the core 29, the roll flange portions f3, f4, etc., for forming the separation material roll R3 are stored in the second storage part 5. The third storage part 4 stores the take-up mechanism 40 for forming the printed adhesive tape roll R2.

In this state, an operator manually peels off the separation material layer 151 from the adhesive tape 150 and attaches a tip end of the tape made up of the print-receiving layer 154, the base layer 153, and the adhesive layer 152 to the core 41 of the take-up mechanism 40. When the feeding roller 12 is driven, the adhesive tape 150 is fed out by the rotation of the adhesive tape roll R1 stored in the first storage part 3 and is fed toward the front side. On the print-receiving layer 154 of the adhesive tape 150 being fed, the printing head 11 forms the desired print portion 155 to turn the tape into the printed adhesive tape 150'. When the printed adhesive tape 150' after print formation is further fed toward the front side to the peeling portion 17, the peeling portion 17 peels off the separation material layer 151 to turn the tape into the printed adhesive tape 150". The peeled separation material layer 151 is fed toward the bottom side and introduced into the second storage part 5 and is wound around the outer circumferential portion of the core 29 in the second storage part 5 to form the separation material roll R3.

On the other hand, the printed adhesive tape 150" after peel-off of the separation material layer 151 is further fed toward the front side and introduced into the third storage part 4 and is wound around the outer circumferential portion of the core 41 of the take-up mechanism 40 in the third storage part 4 to form the printed adhesive tape roll R2. In this state, the cutter mechanism 30 disposed downstream in the tape feeding direction (i.e., on the front side) cuts the printed adhesive tape 150". This enables the operator to cut the printed adhesive tape 150" taken up by the core 41 at desired timing and to take out the printed adhesive tape roll R2 from the third storage part 4 after cutting.

Although not described with reference to the drawings, the printed adhesive tape roll R2 may be formed by winding the printed adhesive tape 150' including the separation material layer 151 around the outer circumferential portion of the core 41 of the take-up mechanism 40 without peeling off the separation material layer 151 from the printed adhesive tape 150'.

Although not described with reference to the drawings, a print-receiving tape without adhesiveness, i.e., non-adhesive tape (tape without the above described adhesive layer 152 and separation material layer 151) may be wound in the roll R1. Also in this case, when the tape cartridge TK is mounted, the roll R1 formed by winding the non-adhesive tape is received from above and stored in the first storage part 3 with the axis O1 of winding of the non-adhesive tape defined in the left-right direction. While being stored in the first storage part 3 (while the tape cartridge TK is mounted), the roll R1 rotates in a predetermined rotation direction (direction A in FIG. 2) in the first storage part 3 to feed out the non-adhesive tape.

In this case, a chute 15 (see FIG. 2) may be disposed for switching the feeding path of the non-adhesive tape (or the above described adhesive tape 150) between a path toward the roll R2 and a path toward a discharging exit (not shown). In particular, by switching the above described feeding path through a switching operation of the chute 15 with a switching lever (not shown), the non-adhesive tape (or the above described printed adhesive tape 150' or the above described printed adhesive tape 150") after print formation may directly be discharged without winding in the third storage part 4, to the outside of the housing 2 from the discharging exit (not shown) disposed on the housing 2 on the side of the second openable cover 8*b*, for example.

<Control System of Printer>

A control system of the printer 1 will be described with reference to FIG. 7.

Figure 7:
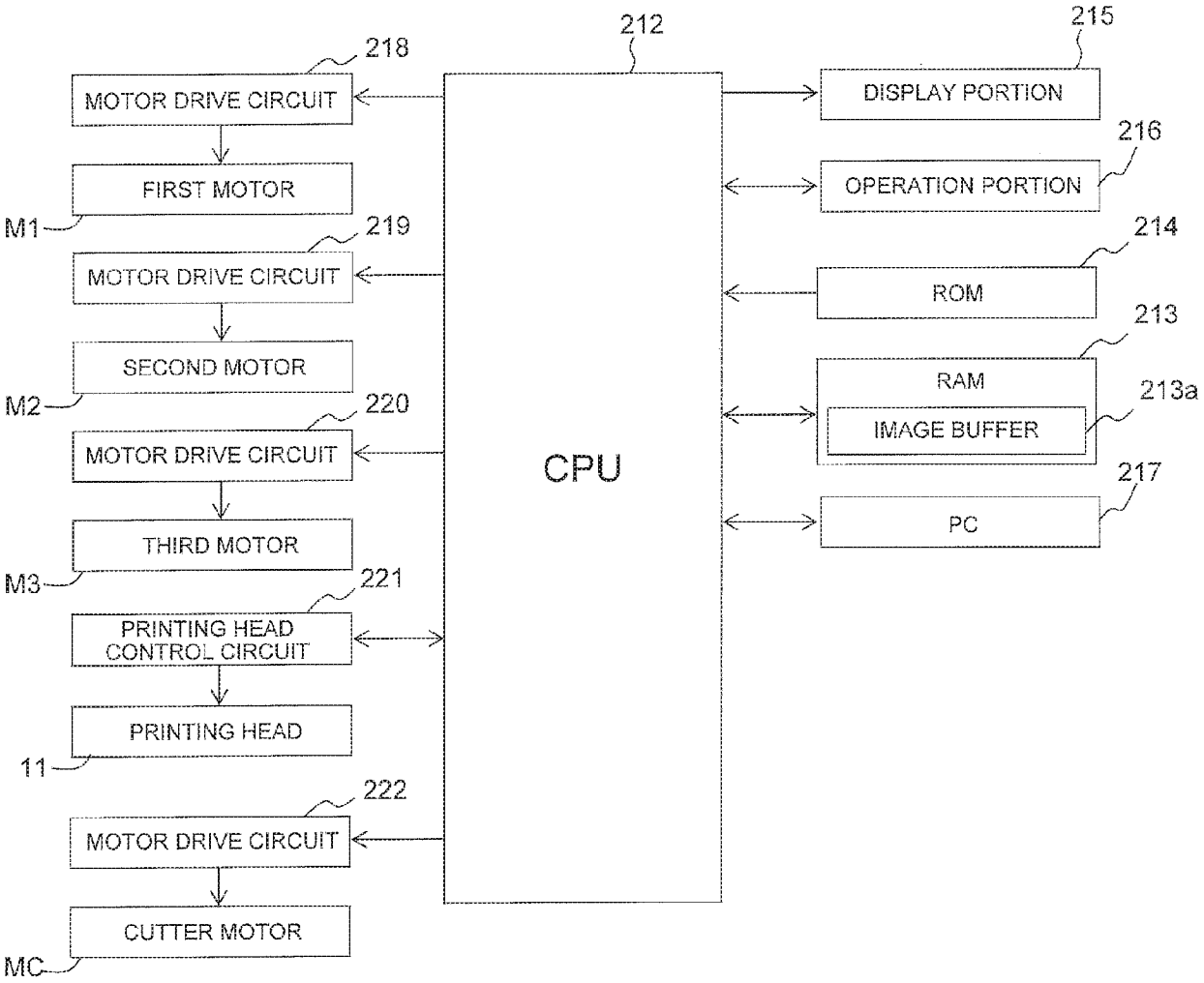
FIG. 7 is a functional block diagram of a structure of a control system of the printer.

As shown in FIG. 7, the printer 1 includes a CPU 212 making up a calculation portion executing a predetermined calculation. The CPU 212 is connected to a RAM 213 and a ROM 214. The CPU 212 executes a signal process in accordance with a program stored in the ROM 214 in advance while using a temporary storage function of the RAM 213, thereby generally controlling the printer 1.

The CPU 212 is also connected to a motor drive circuit 218 carrying out drive control of the above described first motor M1, a motor drive circuit 219 carrying out drive control of the above described second motor M2, a motor drive circuit 220 carrying out drive control of the above described third motor M3, a printing head control circuit 221 carrying out energization control of a heat generation element (not shown) of the above described printing head 11, a motor drive circuit 222 carrying out drive control of the above described cutter motor MC, a display portion 215 performing suitable display, and an operation portion 216 allowing an operator to perform operation and input as needed. Although the CPU 212 is connected to a PC 217 that is an external terminal in this example, the CPU 212 may not be connected to the external terminal if the printer 1 independently operates (as a so-called all-in-one type).

The ROM 214 stores a control program for executing a predetermined control process (including a program executing processes shown in flowcharts of FIGS. 12 and 13 described later). A correction amount table shown in FIG. 10 described later is also stored in the ROM 214.

The RAM 213 includes an image buffer 213*a* in which, for example, print data generated in accordance with an operation by an operator on the operation portion 216 (or the PC 217) is developed and stored as dot pattern data (one unit print data) for printing in a predetermined print area of the print-receiving layer 154 of the above described adhesive tape 150. Based on the above described control program, the CPU 212 repeatedly prints one image (unit print image) corresponding to the dot pattern data stored in the image buffer 213*a* on the print-receiving layer 154 of the adhesive tape 150 with the printing head 11 while feeding the adhesive tape 150 with the feeding roller 12.

<Characteristics of this Embodiment>

This embodiment configured as described above is characterized by a technique of preventing occurrence of a displacement in the width direction of the printed adhesive tape 150" in the printed adhesive tape roll R2 and a protrusion of an adhesive contained in the printed adhesive tape 150" in the printed adhesive tape roll R2 from a roll side surface so as to prevent a deterioration in roll quality even if a tension of the printed adhesive tape 150" may become large for some reason. Details thereof will hereinafter be described in order.

<Drive Torque Control>

As described above, the adhesive tape 150 fed out from the adhesive tape roll R1 is fed by the feeding roller 12 driven by the first motor M1. The printing head 11 forms the desired print portion 155 on the print-receiving layer 154 of the adhesive tape 150 at a desired printing speed, thereby generating the printed adhesive tape 150'. Subsequently, the printed adhesive tape 150" is generated by peeling off the separation material layer 151 from the printed adhesive tape 150' and is sequentially taken up around the outer circumferential portion of the core 41 driven by the second motor M2 to form the printed adhesive tape roll R2.

The feeding/taking-up behavior as described above causes forces to act on the adhesive tape 150 both at the time of contact and feeding by the feeding roller 12 and at the time of taking-up by the core 41. In this embodiment, the CPU 212 provides the drive control of the second motor M2 though the motor drive circuit 219 in accordance with a known technique (in synchronization with the drive control of the printing head 11 through the printing head control circuit 221) such that the tape is smoothly fed and taken up while keeping the balance between these two forces so as to achieve the above described desired printing speed. The drive torque of the second motor M2 in this case is controlled by the motor drive circuit 219 to a desired drive torque (hereinafter also referred to as "first drive torque") that is a standard value determined appropriately in advance (e.g., a theoretical value acquired without giving particular consideration to the occurrence of a displacement in the width direction of the printed adhesive tape 150" in the printed adhesive tape roll R2 and a protrusion of an adhesive contained in the printed adhesive tape 150" in the printed adhesive tape roll R2 from the roll side surface due to a large tension (described later in detail) and the occurrence of a gap or a sag in the laminate structure of the printed adhesive tape 150" in the printed adhesive tape roll R2 due to a small tension (described later in detail)). Specifically, the motor drive circuit 219 provides constant torque control for the second motor M2. This constant torque control will hereinafter be described with reference to FIG. 8.

<Constant Torque Control>

Figure 8:
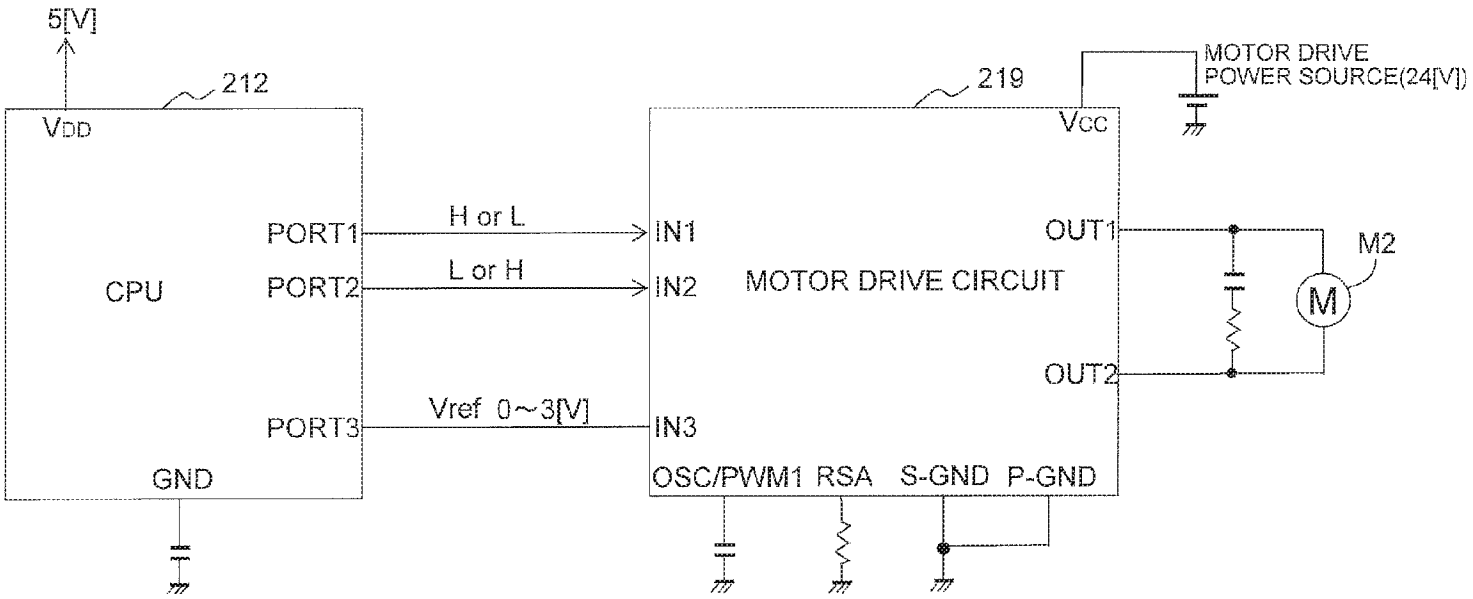
FIG. 8 is a circuit diagram of a circuit connection configuration between a CPU and a motor drive circuit.

As shown in FIG. 8, the CPU 212 includes three communication ports PORT1, PORT2, PORT3 and sends respective signals via these communication ports PORT1, PORT2, PORT3 to three input terminals IN1, IN2, IN3 of the motor drive circuit 219.

The motor drive circuit 219 includes two output terminals OUT1, OUT2. The output terminal OUT1 is connected to one polarity of the second motor M2 and the output terminal OUT2 is connected to the other polarity of the second motor M2.

The CPU 212 transmits a high-level signal H or a low-level signal L via the communication port PORT1 to the motor drive circuit 219, and the motor drive circuit 219 inputs the high-level signal H or the low-level signal L via the input terminal IN1. The CPU 212 transmits a high-level signal H or a low-level signal L at the level opposite to the communication port PORT1 via the communication port PORT2 to the motor drive circuit 219, and the motor drive circuit 219 inputs the high-level signal H or the low-level signal L via the input terminal IN2.

For example, when the CPU 212 transmits the high-level signal H via the communication port PORT1 to the motor drive circuit 219 and transmits the low-level signal L via the communication port PORT2 to the motor drive circuit 219, the motor drive circuit 219 inputs the high-level signal H via the input terminal IN1 and inputs the low-level signal L via the input terminal IN2, thereby rotating the second motor M2 in the forward direction.

On the other hand, when the CPU 212 transmits the low-level signal L via the communication port PORT1 to the motor drive circuit 219 and transmits the high-level signal H via the communication port PORT2 to the motor drive circuit 219, the motor drive circuit 219 inputs the low-level signal L via the input terminal IN1 and inputs the high-level signal H via the input terminal IN2, thereby rotating the second motor M2 in the reverse direction.

The CPU 212 transmits a voltage command value Vref set to a voltage (e.g., 0 to 3 [V]) via the communication port PORT3 to the motor drive circuit 219, and the motor drive circuit 219 inputs the voltage command value Vref via the input terminal IN3. This causes the motor drive circuit 219 to provide the constant torque control of setting the drive torque of the second motor M2 to a constant value corresponding to the input voltage command value Vref.

In this case, the value of the voltage command value Vref input to the motor drive circuit 219 is controlled by the CPU 212 to a desired voltage command value (hereinafter also referred to as a "first voltage command value") corresponding to the above described first drive torque. Therefore, the motor drive circuit 219 provides the constant torque control such that the drive torque of the second motor M2 is set to a constant value corresponding to the input first voltage command value.

<Increase in Tension of Printed Adhesive Tape>

Even if the constant torque control using the first voltage command value as described above is provided, the tension of the printed adhesive tape 150" may become large for some reason.

For example, if a tape width of the adhesive tape 150 (tape width) is relatively narrow, the printed adhesive tape 150" wound into a roll shape is in close contact with itself in a small area and is therefore strongly tightened and the tension of the printed adhesive tape 150" easily becomes excessively large. If the outer diameter of the core 41 is relatively small, a tension applied to the printed adhesive tape 150" easily becomes large when the printed adhesive tape 150" is taken up by the core 41 under the constant torque control. For example, if a type of the adhesive tape 150 is of relatively small friction coefficient such as fabric, the drive torque of the motor drive circuit 219 overcomes the drive of the feeding roller 12 and strongly acts and the tension of the printed adhesive tape 150" easily becomes large. For example, if a length of the printed adhesive tape 150" taken up and wound into a roll shape by the core 41 (hereinafter also referred to as "take-up tape length") is relatively short, the overall outer diameter of the printed adhesive tape roll R2 is relatively small and the tension applied to the printed adhesive tape 150" easily becomes large as described above under the constant torque control.

Figure 9A:
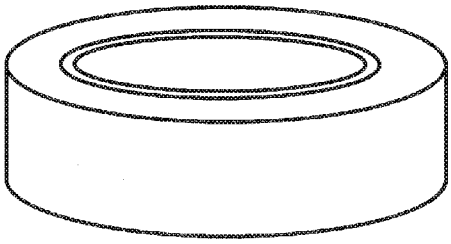
FIG. 9A is an explanatory view of a form of a printed adhesive tape roll when tension is large.
Figure 9B:
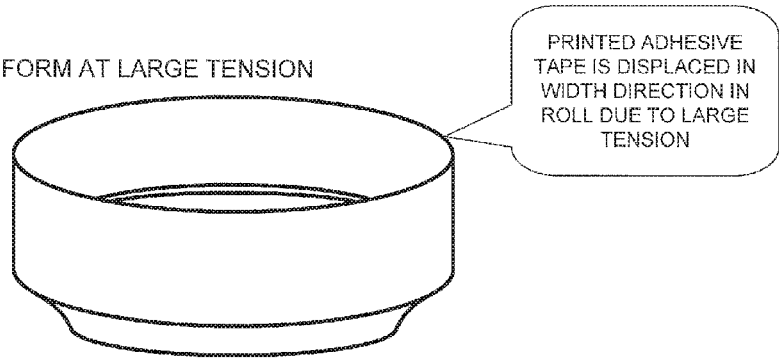
FIG. 9B is an explanatory view of a form of a printed adhesive tape roll when tension is large.
Figure 9C:
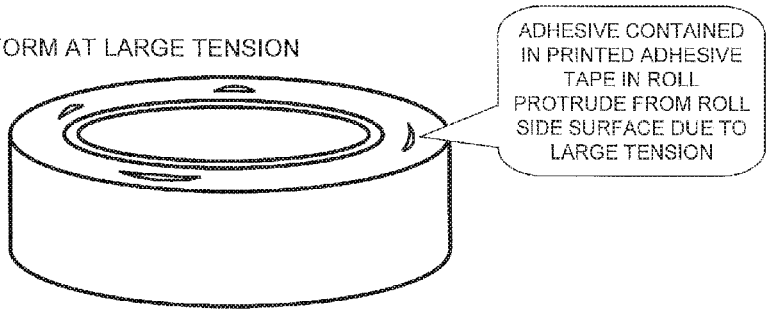
FIG. 9C is an explanatory view of a form of a printed adhesive tape roll when tension is large.

In these cases, since the tension of the printed adhesive tape 150" becomes large, the printed adhesive tape roll R2 seeks to release the force therein. As a result, when the tension of the printed adhesive tape 150" becomes large, for example, as shown in FIGS. 9A, 9B, and 9C for comparison, the printed adhesive tape 150" is displaced in the width direction in the printed adhesive tape roll R2 (see FIG. 9B) as compared to the intended roll form (see FIG. 9A), resulting in the occurrence of a so-called telescopic roll deformation or the protrusion of the adhesive contained in the printed adhesive tape 150" in the printed adhesive tape roll R2 (see FIG. 9C).

<Correction of Voltage Command Value>

In this embodiment, to deal with the possibility of the tension of the printed adhesive tape 150" becoming large as described above due to the above described reasons during provision of the constant torque control using the first voltage command value described above, the CPU 212 corrects the value of the voltage command value Vref output to the motor drive circuit 219 from the first voltage command value to a voltage command value (hereinafter also referred to as a "second voltage command value") corresponding to a drive torque of the second motor M2 (hereinafter also referred to as a "second drive torque") in accordance with the above described tape width, outer diameter (outer diameter dimension) of the core 41, tape type, and take-up tape length. Specifically, if the tension of the printed adhesive tape 150" may become large as described above, the value of the voltage command value Vref is corrected to the second voltage command value making the drive torque of the second motor M2 smaller as compared to the first voltage command value.

In this case, since the above described take-up tape length increases and the overall outer diameter of the printed adhesive tape roll R2 increases every moment as the core 41 sequentially takes up the printed adhesive tape 150", the CPU 212 accordingly dynamically corrects the value of the voltage command value Vref output to the motor drive circuit 219 from the first voltage command value to a plurality of values defined as the above described second voltage command value. Specifically, the correction is made such that as the above described take-up tape length becomes longer, the second voltage command value becomes larger (in other words, the correction amount of the first voltage command value becomes smaller).

<Correction Amount Table>

In this embodiment, to acquire a correction amount of the first voltage command value at the time of the above described correction, the above described ROM 214 stores a correction amount table indicative of a correction amount of the first voltage command value corresponding to a combination of the above described tape width, outer diameter of the core 41, tape type, and take-up tape length. FIG. 10 shows an example of the correction amount table.

In the example shown in FIG. 10, the tape width is categorized into three types of 15 [mm], 38 [mm], and 50 [mm] The outer diameter of the core 41 (described as "core outer diameter" in FIG. 10) is categorized into two types of 75 [mm] and 30 [mm] The three tape types are defined as an OPP material (oriented polypropylene; described as "OPP" in FIG. 10), a PET material (polyethylene terephthalate; described as "PET" in FIG. 10), and a fabric material (described as "FAB" in FIG. 10). Assuming that the maximum value of the take-up tape length is 30 [m], the take-up tape length is divided into six stages, i.e., a stage of not less than 0 [m] and less than 5 [m] (described as "0-4" for simplicity in FIG. 10), a stage of not less than 5 [m] and less than 10 [m] (described as "5-9" for simplicity in FIG. 10), a stage of not less than 10 [m] and less than 15 [m] (described as "10-14" for simplicity in FIG. 10), a stage of not less than 15 [m] and less than 20 [m] (described as "15-19" for simplicity in FIG. 10), a stage of not less than 20 [m] and less than 25 [m] (described as "20-24" for simplicity in FIG. 10), a stage of not less than 25[m] and not more than 30 [m] (described as "25-30" for simplicity in FIG. 10). The correction amount (in [%]; in FIG. 10, "Δ" is added to an amount having a negative value) of the first voltage command value is determined in accordance with a combination of the tape width, the outer diameter of the core 41, the tape type, and the take-up tape length.

For example, in the case of the tape width of 15 [mm], the outer diameter of the core 41 of 75 [mm], and the tape type of the OPP material, the correction amount is Δ40[%] if the take-up tape length is not less than 0 [m] and less than 5 [m]; the correction amount is Δ40[%] if the take-up tape length is not less than 5 [m] and less than 10 [m]; the correction amount is Δ35[%] if the take-up tape length is not less than 10 [m] and less than 15 [m]; the correction amount is Δ35[%] if the take-up tape length is not less than 15 [m] and less than 20 [m]; the correction amount is Δ30[%] if the take-up tape length is not less than 20 [m] and less than 25 [m]; and the correction amount is Δ30[%] if the take-up tape length is not less than 25 [m] and not more than 30 [m].

For example, in the case of the tape width of 50 [mm], the outer diameter of the core 41 of 75 [mm], and the tape type of the OPP material, the correction amount is Δ15[%] if the take-up tape length is not less than 0 [m] and less than 5 [m]; the correction amount is Δ15[%] if the take-up tape length is not less than 5 [m] and less than 10 [m]; the correction amount is Δ10[%] if the take-up tape length is not less than 10 [m] and less than 15 [m]; the correction amount is Δ10[%] if the take-up tape length is not less than 15 [m] and less than 20 [m]; the correction amount is Δ5[%] if the take-up tape length is not less than 20 [m] and less than 25 [m]; and the correction amount is Δ5[%] if the take-up tape length is not less than 25 [m] and not more than 30 [m].

For example, in the case of the tape width of 15 [mm], the outer diameter of the core 41 of 30 [mm], and the tape type of the OPP material, the correction amount is Δ50[%] if the take-up tape length is not less than 0 [m] and less than 5 [m]; the correction amount is Δ50[%] if the take-up tape length is not less than 5 [m] and less than 10 [m]; the correction amount is Δ45[%] if the take-up tape length is not less than 10 [m] and less than 15 [m]; the correction amount is Δ45[%] if the take-up tape length is not less than 15 [m] and less than 20 [m]; the correction amount is Δ40[%] if the take-up tape length is not less than 20 [m] and less than 25 [m]; and the correction amount is Δ40[%] if the take-up tape length is not less than 25 [m] and not more than 30 [m].

For example, in the case of the tape width of 15 [mm], the outer diameter of the core 41 of 75 [mm], and the tape type of the fabric material, the correction amount is Δ45[%] if the take-up tape length is not less than 0 [m] and less than 5 [m]; the correction amount is Δ45[%] if the take-up tape length is not less than 5 [m] and less than 10 [m]; the correction amount is Δ40[%] if the take-up tape length is not less than 10 [m] and less than 15 [m]; the correction amount is Δ40[%] if the take-up tape length is not less than 15 [m] and less than 20 [m]; the correction amount is Δ35[%] if the take-up tape length is not less than 20 [m] and less than 25 [m]; and the correction amount is Δ35[%] if the take-up tape length is not less than 25 [m] and not more than 30 [m].

Figure 11:
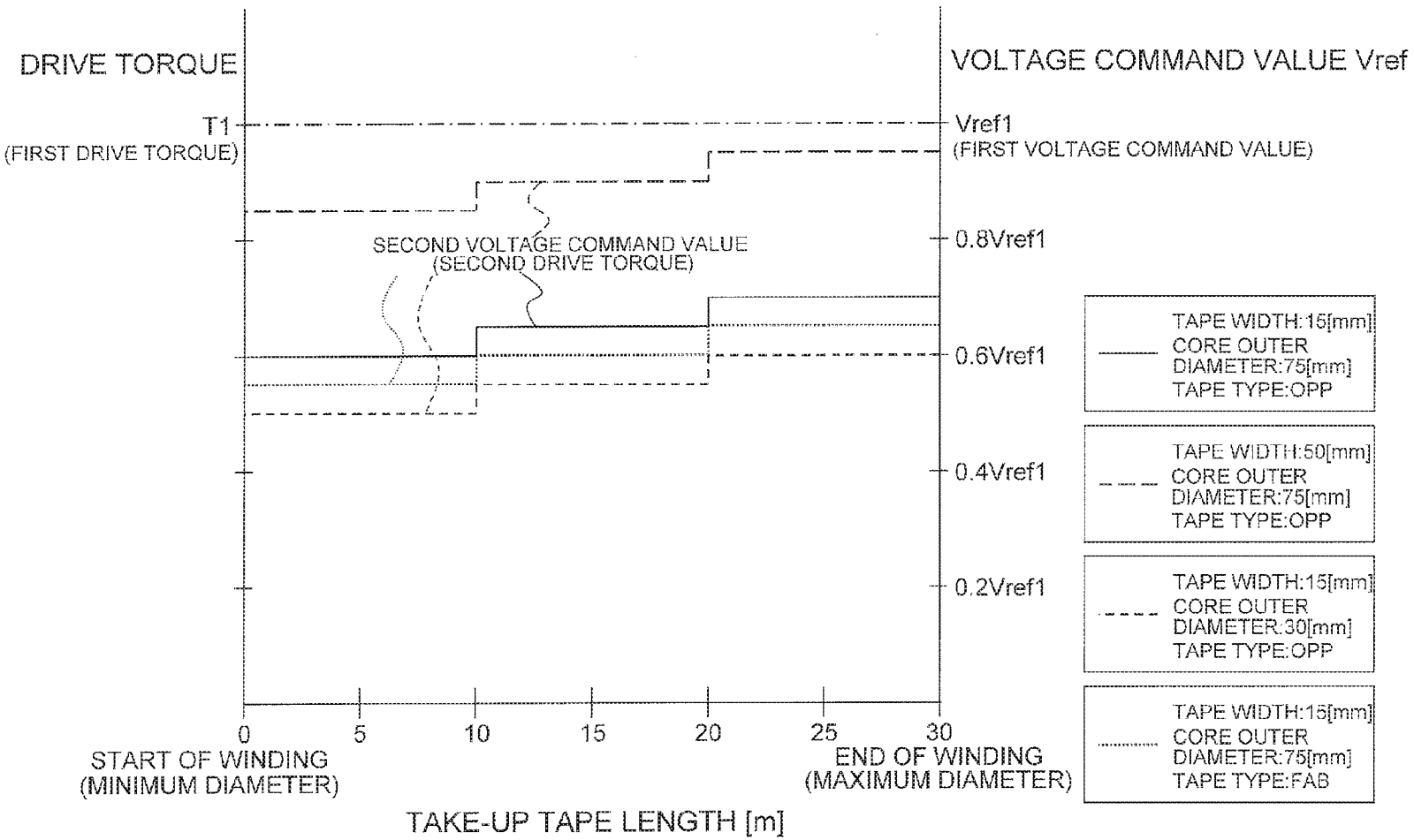
FIG. 11 is an explanatory view of an example of a correction technique for the first voltage command value using the correction amount table.

An example of the correction technique for the first voltage command value using the above described correction amount table will hereinafter be described with reference to FIG. 11. FIG. 11 shows graphed relationships of the take-up tape length, the drive torque of the second motor M2, and the voltage command value Vref in the case of the tape width of 15 [mm], the outer diameter of the core 41 of 75 [mm], and the tape type of the OPP material; in the case of the tape width of 50 [mm], the outer diameter of the core 41 of 75 [mm], and the tape type of the OPP material; in the case of the tape width of 15 [mm], the outer diameter of the core 41 of 30 [mm], and the tape type of the OPP material; and in the case of the tape width of 15 [mm], the outer diameter of the core 41 of 75 [mm], and the tape type of the fabric material. In FIG. 11, T1 denotes the first drive torque and Vref1 denotes the first voltage command value corresponding to the first drive torque T1.

As shown in FIG. 11, in the case of the tape width of 15 [mm], the outer diameter of the core 41 of 75 [mm], and the tape type of the OPP material, if the take-up tape length is not less than 0 [m] and less than 5 [m] or is not less than 5 [m] and less than 10 [m], the correction amount is Δ40[%] and the first voltage command value Vref1 is therefore reduced by 40[%] to set 0.6 Vref1 as the second voltage command value. If the take-up tape length is not less than 10 [m] and less than 15 [m] or is not less than 15 [m] and less than 20 [m], the correction amount is 435[%] and the first voltage command value Vref1 is therefore reduced by 35[%] to set 0.65 Vref1 as the second voltage command value. If the take-up tape length is not less than 20 [m] and less than 25 [m] or is not less than 25 [m] and not more than 30 [m], the correction amount is Δ30[%] and the first voltage command value Vref1 is therefore reduced by 30[%] to set 0.7 Vref1 as the second voltage command value.

Similarly, in the case of the tape width of 50 [mm], the outer diameter of the core 41 of 75 [mm], and the tape type of the OPP material, if the take-up tape length is not less than 0 [m] and less than 5 [m] or is not less than 5 [m] and less than 10 [m], the correction amount is Δ15 [%] and the first voltage command value Vref1 is therefore reduced by 15[%] to set 0.85 Vref1 as the second voltage command value. If the take-up tape length is not less than 10 [m] and less than 15 [m] or is not less than 15 [m] and less than 20 [m], the correction amount is Δ10[%] and the first voltage command value Vref1 is therefore reduced by 10[%] to set 0.9 Vref1 as the second voltage command value. If the take-up tape length is not less than 20 [m] and less than 25 [m] or is not less than 25 [m] and not more than 30 [m], the correction amount is Δ5[%] and the first voltage command value Vref1 is therefore reduced by 5[%] to set 0.95 Vref1 as the second voltage command value.

Similarly, in the case of the tape width of 15 [mm], the outer diameter of the core 41 of 30 [mm], and the tape type of the OPP material, if the take-up tape length is not less than 0 [m] and less than 5 [m] or is not less than 5 [m] and less than 10 [m], the correction amount is Δ50 [%] and the first voltage command value Vref1 is therefore reduced by 50[%] to set 0.5 Vref1 as the second voltage command value. If the take-up tape length is not less than 10 [m] and less than 15 [m] or is not less than 15 [m] and less than 20 [m], the correction amount is Δ45[%] and the first voltage command value Vref1 is therefore reduced by 45[%] to set 0.55 Vref1 as the second voltage command value. If the take-up tape length is not less than 20 [m] and less than 25 [m] or is not less than 25 [m] and not more than 30 [m], the correction amount is 440[%] and the first voltage command value Vref1 is therefore reduced by 40[%] to set 0.6 Vref1 as the second voltage command value.

Similarly, in the case of the tape width of 15 [mm], the outer diameter of the core 41 of 75 [mm], the tape type of the fabric material, of the take-up tape length is not less than 0 [m] and less than 5 [m] or is not less than 5 [m] and less than 10 [m], the correction amount is Δ45[%] and the first voltage command value Vref1 is therefore reduced by 45[%] to set 0.55 Vref1 as the second voltage command value. If the take-up tape length is not less than 10 [m] and less than 15 [m] or is not less than 15 [m] and less than 20 [m], the correction amount is 440[%] and the first voltage command value Vref1 is therefore reduced by 40[%] to set 0.6 Vref1 as the second voltage command value. If the take-up tape length is not less than 20 [m] and less than 25 [m] or is not less than 25 [m] and not more than 30 [m], the correction amount is 435[%] and the first voltage command value Vref1 is therefore reduced by 35[%] to set 0.65 Vref1 as the second voltage command value.

As can be understood by comparing the cases that the conditions other than the tape width are equivalent, for example, by comparing the case of the tape width of 15 [mm], the outer diameter of the core 41 of 75 [mm], and the tape type of the OPP material with the case of the tape width of 50 [mm], the outer diameter of the core 41 of 75 [mm], and the tape type of the OPP material, the correction is made such that the second voltage command value becomes smaller (in other words, the correction amount of the first voltage command value becomes larger) in the case of the tape width of 15 [mm] as compared to the case of the tape width of 50 [mm].

As can be understood by comparing the cases that the conditions other than the outer diameter of the core 41 are equivalent, for example, by comparing the case of the tape width of 15 [mm], the outer diameter of the core 41 of 75 [mm], and tape type of the OPP material with the case of the tape width of 15 [mm], the outer diameter of the core 41 of 30 [mm], and the tape type of the OPP material, the correction is made such that the second voltage command value becomes smaller (in other words, the correction amount of the first voltage command value becomes larger) in the case of the outer diameter of the core 41 of 30 [mm] as compared to the case of the outer diameter of the core 41 of 75 [mm].

As can be understood by comparing the cases that the conditions other than the tape type are equivalent, for example, by comparing the case of the tape width of 15 [mm], the outer diameter of the core 41 of 75 [mm], and the tape type of the OPP material with the case of the tape width of 15 [mm], the outer diameter of the core 41 of the 75 [mm], and the tape type of the fabric material, the correction is made such that the second voltage command value becomes smaller (in other words, the correction amount of the first voltage command value becomes larger) in the case of the tape type of the fabric material as compared to the case of the tape type of the OPP material.

As can be understood by comparing the cases that the tape width, the outer diameter of the core 41, and the tape type are equivalent, for example, by comparing the stages of the take-up tape length with each other in the case of the tape width of 15 [mm], the outer diameter of the core 41 of 75 [mm], and the tape type of the OPP material, the correction is made such that the second voltage command value becomes smaller (in other words, the correction amount of the first voltage command value becomes larger) in the stages of shorter take-up tape length as compared to the stages of longer take-up tape length. In other words, the correction is made such that the second voltage command value becomes larger (in other words, the correction amount of the first voltage command value becomes smaller) as the take-up tape length becomes longer.

<Constant Torque Control Using Second Voltage Command Value>

The CPU 212 outputs the above described second voltage command value after the correction (smaller than the above described first voltage command value) to the motor drive circuit 219. Specifically, the CPU 212 sequentially outputs to the motor drive circuit 219 a plurality of the above described second voltage command values after the correction (smaller than the above described first voltage command value) corrected such that the value becomes larger (in other words, the correction amount of the first voltage command value becomes smaller) as the take-up tape length becomes longer. The motor drive circuit 219 provides the constant torque control such that the drive torque of the second motor M2 is set to a constant value corresponding to the input second voltage command value. As a result, the tension of the printed adhesive tape 150" can be prevented from becoming large.

<Control Flow>

Details of the process executed by the CPU 212 for implementing the technique described above will hereinafter be described with reference to FIG. 12.

Figure 12:
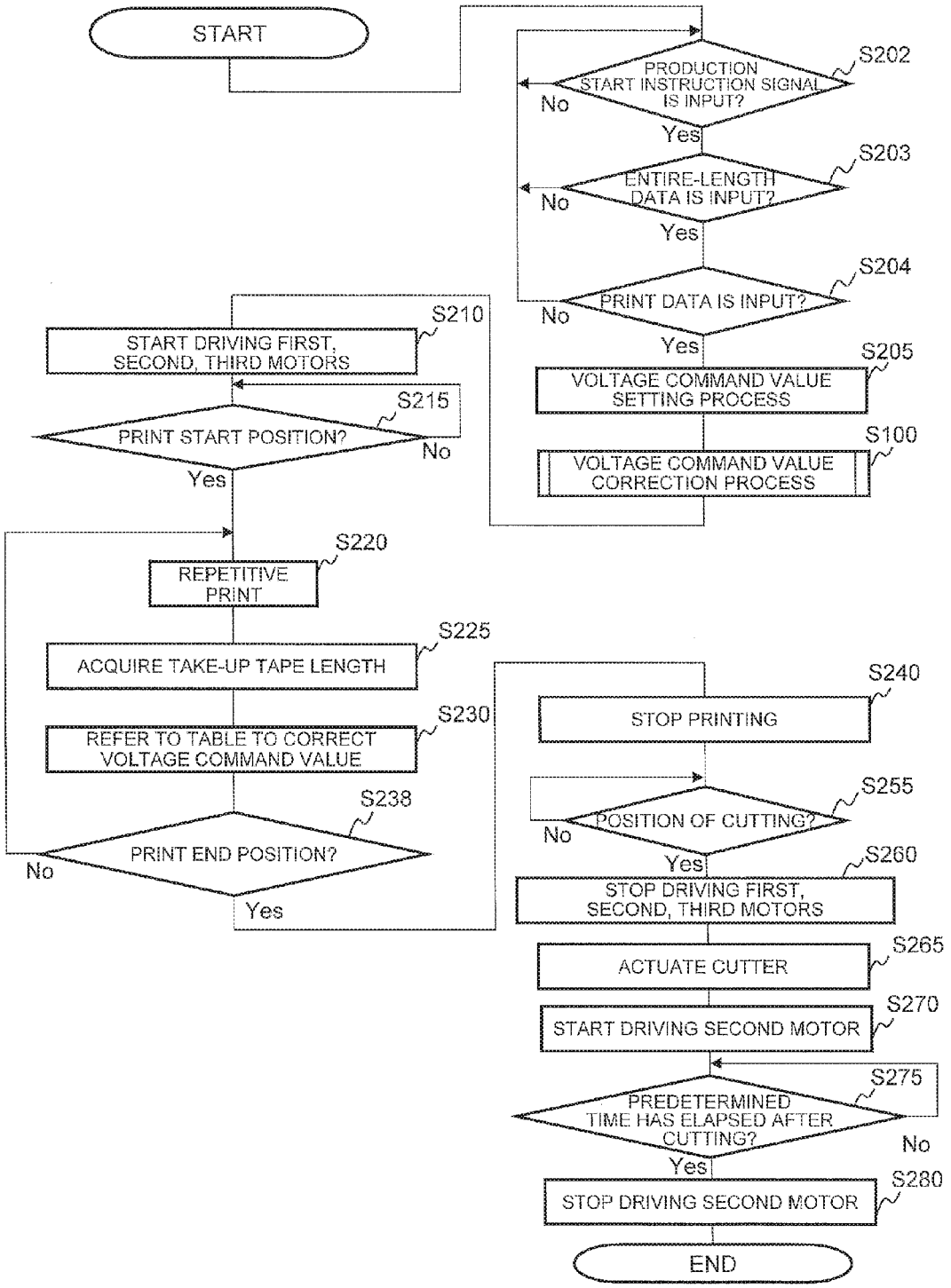
FIG. 12 is a flowchart of a control procedure executed by the CPU.

In FIG. 12, for example, an operator powers on the printer 1 and the process shown in the flowchart of FIG. 12 is started ("START" position).

At step S202, the CPU 212 determines whether a production start instruction signal for the printed adhesive tape 150" is input in accordance with a production start operation for the printed adhesive tape 150" by the operator on the operation portion 216 (or the PC 217). If the production start instruction signal is not input, the determination at step S202 is negative (S202:NO) and the CPU 212 waits in a loop. If the production start instruction signal is input, the determination at step S202 is affirmative (S202:YES) and the CPU 212 goes to step S203.

At step S203, the CPU 212 determines whether entire-length data is input that represents the entire length of the printed adhesive tape 150" to be produced along the tape feeding direction, in accordance with an operation by the operator on the operation portion 216 (or the PC 217). If the entire-length data is not input, the determination at step S203 is negative (S203:NO) and the CPU 212 returns to above described step S202 to repeat the same procedure. If the entire-length data is input, the determination at step S203 is affirmative (S203:YES) and the CPU 212 goes to step S204.

At step S204, the CPU 212 determines whether the above described one unit print data for repeatedly forming a print on the adhesive tape 150 is input based on an operation by the operator on the operation portion 216 (or the PC 217). If the unit print data is not input, the determination at step S204 is negative (S204:NO) and the CPU 212 returns to above described step S202 to repeat the same procedure. If the unit print data is input, the determination at step S204 is affirmative (S204:YES) and the CPU 212 goes to step S205.

At step S205, the CPU 212 executes a voltage command value setting process to set the voltage command value Vref for the above described motor drive circuit 219 with a known technique (in synchronization with the drive control of the printing head 11) so as to achieve a desired printing speed set in advance. The voltage command value Vref in this case is set to the above described first voltage command value that is the standard value determined appropriately in advance. Although not described in detail, the voltage command value Vref for the above described motor drive circuit 218 and the voltage command value Vref for the above described motor drive circuit 220 are also set in accordance with the voltage command value Vref for the motor drive circuit 219 set in this way. Subsequently, the CPU 212 goes to step S100.

At step S100, the CPU 212 executes the voltage command value correction process (see FIG. 13 described later for details) to correct a value of the voltage command value Vref output to the above described motor drive circuit 219 from the first voltage command value set at above described step S205 to the above described second voltage command value.

<Voltage Command Value Correction Process>

A detailed procedure of the voltage command value correction process of above described step S100 will hereinafter be described with reference to FIG. 13.

Figure 13:
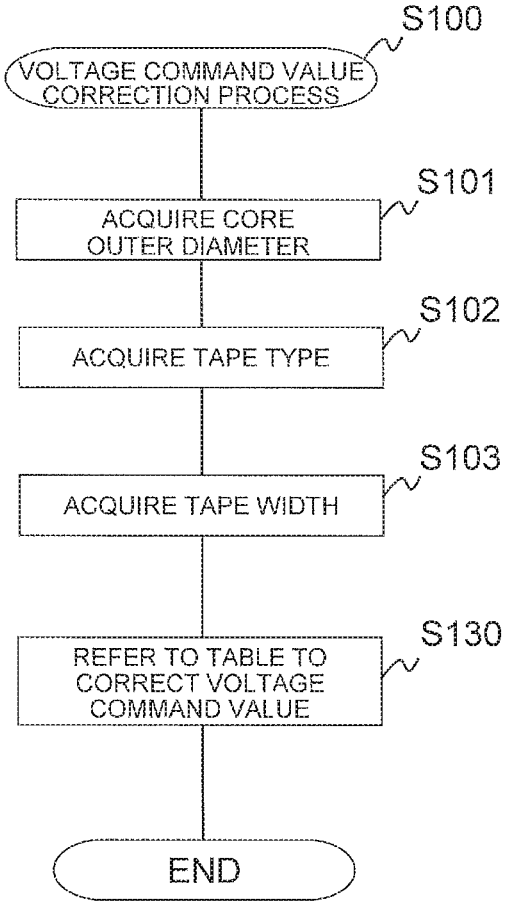
FIG. 13 is a flowchart of a detailed procedure of step S100.

In FIG. 13, at step S101, the CPU 212 acquires information on the outer diameter of the above described core 41 (the outer diameter information of the core 41). In this case, the outer diameter information of the core 41 may be acquired by detecting a type of the mounted take-up mechanism 40 with a suitable sensor or may be acquired based on a result of operation input by the operator on the operation portion 216 (or the PC 217).

Subsequently, at step S102, the CPU 212 acquires information on the above described tape type (the tape type information). In this case, the tape type information may be acquired by detecting a type of the mounted tape cartridge TK with a suitable sensor or may be acquired based on a result of operation input by the operator on the operation portion 216 (or the PC 217).

At step S103, the CPU 212 acquires information on the above described tape width (the tape width information). As is the case with the above description, the tape width information may be acquired by detecting a type of the mounted tape cartridge TK with a suitable sensor or may be acquired based on a result of operation input by the operator on the operation portion 216 (or the PC 217).

Subsequently, at step S130, the CPU 212 refers to the correction amount table shown in FIG. 10 described above to extract a correction amount in accordance with a combination of the outer diameter information of the core 41 acquired at above described step S101, the tape type information acquired at above described step S102, the tape width information acquired at above described step S103, and information on the take-up tape length information (i.e., 0 [m]). The CPU 212 uses the extracted correction amount to correct the first voltage command value set at above described step S205 to the above described second voltage command value. The CPU 212 then terminates the process of this routine and goes to step S210.

As described in FIG. 12, at step S210, the CPU 212 outputs a control signal (i.e., the voltage command value Vref set/corrected at above described steps S205 and S210) to the motor drive circuits 218, 219, 220 to start driving the first motor M1, the adhesive take-up motor M2, and the third motor M3. Particularly, the drive control of the second motor M2 is provided by the motor drive circuit 219 to which the second voltage command value corrected at above described step S100 is input, such that the drive torque is set to a constant value corresponding to the second voltage command value. This leads to the start of feeding of the above described adhesive tape 150, the printed adhesive tape 150', and the printed adhesive tape 150" (hereinafter also simply referred to as "tape feeding") and taking-up of the above described printed adhesive tape 150".

At step S215, the CPU 212 determines with a known technique whether the tape feeding reaches a state in which the printing head 11 faces a print start position, based on the unit print data input at above described step S204. If the print start position is not reached, the determination at step S215 is negative (S215:NO) and the CPU 212 waits in a loop. If the print start position is reached, the determination at step S215 is affirmative (S215:YES) and the CPU 212 goes to step S220.

At step S220, the CPU 212 outputs a control signal to the printing head control circuit 221 to energize the heat generation element of the printing head 11, thereby starting repetitive print formation of the unit print image corresponding to the unit print data input at above described step S204 on the adhesive tape 150. Subsequently, the CPU 212 goes to step 225.

At step S225, the CPU 212 acquires information on the above described take-up tape length (the take-up tape length information). In this case, the take-up tape length information may be acquired by a suitable known technique, for example, by detecting an outer diameter dimension of the printed adhesive tape roll R2 with a suitable sensor and calculating the take-up tape length based on the detection result, or by calculating a tape feeding amount after the start of a tape feeding operation based on the number of pulses included in a control pulse signal to the first motor M1.

Subsequently, at step S230, the CPU 212 refers to the correction amount table shown in FIG. 10 described above to extract a correction amount in accordance with a combination of the outer diameter information of the core 41 acquired at above described step S101, the tape type information acquired at above described step S102, the tape width information acquired at above described step S103, and the take-up tape length information acquired at above described step S225. The CPU 212 uses the extracted correction amount to correct the first voltage command value set at above described step S205 to the above described second voltage command value, thereby setting the second voltage command value to the value corresponding to the current take-up tape length. In particular, at this step S230, the CPU 212 uses the correction amount corresponding to the above described take-up tape length increasing as the core 41 sequentially takes up the printed adhesive tape 150", for dynamically correcting the value of the voltage command value Vref output to the motor drive circuit 219 to a plurality of values defined as the second voltage command value. Subsequently, the drive control of the second motor M2 is provided by the motor drive circuit 219 to which the second voltage command value corrected at this step S230 is input, such that the drive torque is set to a constant value corresponding to the second voltage command value.

At step S238, the CPU 212 determines with a known technique whether the tape feeding reaches a state in which the printing head 11 faces a print end position, based on the unit print data input at above described step S204. If the print end position is not reached, the determination at step S238 is negative (S238:NO) and the CPU 212 returns to above described step S220 to repeat the same procedure. As a result, the repetitive print formation is continued. If the print end position is reached, the determination at step S238 is affirmative (S238:YES) and the CPU goes to step S240.

At step S240, the CPU 212 outputs a control signal to the printing head control circuit 221 to stop energizing the heat generation element of the printing head 11, thereby terminating the print formation on the adhesive tape 150. In this state, the tape feeding is continuously performed. As a result, the subsequent printed adhesive tape 150' becomes blank without a print. Subsequently, the CPU 212 goes to step S255.

At step S255, the CPU 212 determines whether the tape feeding reaches a position of cutting by the cutter mechanism 30 corresponding to the entire-length data input at above described step S203 (a position of cutting at which the entire length in the tape feeding direction of the printed adhesive tape 150" wound as the printed adhesive tape roll R2 reaches the length intended by the operator). If the position of cutting is not reached, the determination at step S255 is negative (S255:NO) and the CPU 212 waits in a loop. If the position of cutting is reached, the determination at step S255 is affirmative (S255:YES) and the CPU 212 goes to step S260.

At step S260, the CPU 212 outputs a control signal to the motor drive circuits 218, 219, 220 to stop driving the first motor M1, the second motor M2, and the third motor M3. As a result, the tape feeding is stopped.

Subsequently, at step S265, the CPU 212 outputs a control signal to the motor drive circuit 222 to drive the cutter motor MC, thereby actuating the cutter mechanism 30 to cut the printed adhesive tape 150".

At step S270, the CPU 212 outputs a control signal to the motor drive circuit 219 to start driving the second motor M2, thereby taking up the printed adhesive tape 150" around the outer circumferential portion of the core 41 of the take-up mechanism 40.

Subsequently, at step S275, the CPU 212 determines whether a predetermined time has elapsed from the cutting operation of the cutter mechanism 30 at above described step S265. If the predetermined time has not elapsed, the determination at step S275 is negative (S275:NO) and the CPU 212 waits in a loop. This predetermined time may be a time required for taking up the printed adhesive tape 150" around the outer circumferential portion of the above described core 41. If the predetermined time has elapsed, the determination at step S275 is affirmative (S275:YES) and the CPU 212 goes to step S280.

At step S280, the CPU 212 outputs a control signal to the motor drive circuit 219 to stop driving the second motor M2. As a result, the printed adhesive tape 150" generated by the above described cutting can reliably be taken up around the outer circumferential portion of the above described core 41. The CPU 212 then terminates the process of this flowchart.

Effects of this Embodiment

As described above, in this embodiment, the CPU 212 corrects the drive torque of the second motor M2 in accordance with the tape width from the first drive torque to the second drive torque (in the above described example, to the second drive torque smaller than the first drive torque). Therefore, the tension can be prevented from becoming excessively large even if the tension of the printed adhesive tape 150" may otherwise become excessively large as described above. As a result, the printed adhesive tape 150" can be prevented from being displaced in the width direction (see FIG. 9B) due to an excessively large tension of the printed adhesive tape 150" and the printed adhesive tape roll R2 can be formed in the correct form.

Particularly, in this embodiment, the CPU 212 corrects the drive torque of the second motor M2 from the first drive torque to the second drive torque also in accordance with the outer diameter of the core 41. Therefore, the printed adhesive tape 150" can reliably be prevented from being displaced in the width direction and the printed adhesive tape roll R2 can be formed in the correct form.

Particularly, in this embodiment, the CPU 212 corrects the drive torque of the second motor M2 from the first drive torque to the second drive torque also in accordance with the tape type and the take-up tape length. Therefore, the above described printed adhesive tape 150" can reliably be prevented from being displaced in the width direction and the printed adhesive tape roll R2 can be formed in the correct form.

Particularly, in this embodiment, the CPU 212 dynamically corrects the drive torque of the second motor M2 to a plurality of values defined as the second drive torque in accordance with the take-up tape length increasing as the core 41 sequentially takes up the printed adhesive tape 150". In particular, in this embodiment, when the printed adhesive tape 150" is sequentially wound into a roll shape, the tension applied to the printed adhesive tape 150" is finely adjusted in accordance with a size of the overall outer diameter of the printed adhesive tape roll R2 changing every moment. Therefore, the above described printed adhesive tape 150" can more reliably be prevented from being displaced in the width direction.

Particularly, in this embodiment, the CPU 212 corrects the voltage command value Vref output to the motor drive circuit 219 providing the constant torque control, in accordance with the tape width, the outer diameter of the core 41, the tape type, and the take-up tape length, from the first voltage command value corresponding to the first drive torque to the second voltage command value corresponding to the second drive torque (in the above described example, to the second voltage command value making the drive torque of the second motor M2 smaller as compared to the first voltage command value). The motor drive circuit 219 provides the constant torque control to set the drive torque of the second motor M2 to a constant value corresponding to the input second voltage command value. Therefore, the tension can be prevented from becoming large even if the tension of the printed adhesive tape 150" may otherwise become large as described above, and the printed adhesive tape 150" can be prevented from being displaced in the width direction so as to form the printed adhesive tape roll R2 in the correct form. Since the first voltage command value is finely and accurately corrected in accordance with all of the tape width, the outer diameter of the core 41, the tape type, and the take-up tape length, the above described printed adhesive tape 150" can reliably be prevented from being displaced in the width direction.

Particularly, in this embodiment, the CPU 212 refers to the correction amount table (see FIG. 10) indicative of the correction amount corresponding to a combination of the tape width, the outer diameter of the core 41, the tape type, and the take-up tape length to correct the first voltage command value to the second voltage command value. In other words, the correction amounts of various cases calculated in advance are stored and used as a table and, therefore, the correction can quickly and reliably be made in a simple process without executing a complicated process. For example, even if the number of the tape types etc. increases in the future and results in an addition of a new parameter or an expansion in value range of parameters for correction amount calculation (in the above described example, the tape width, the outer diameter of the core 41, the tape type, and the take-up tape length), this can easily be addressed by simply supplementing or updating the data of the table.

Particularly, in this embodiment, the cutter mechanism 30 cuts the printed adhesive tape 150" taken up by the core 41 to produce the printed adhesive tape roll R2. Therefore, the above described printed adhesive tape 150" can be prevented from being displaced in the width direction in the printer 1 cutting the printed adhesive tape 150" to produce the printed adhesive tape roll R2 so as to prevent a deterioration in roll quality of the printed adhesive tape roll R2.

Particularly, in this embodiment, the adhesive tape roll R1 of the wound adhesive tape 150 is used and the core 41 takes up the printed adhesive tape 150" around the outer circumference portion. Therefore, the above described printed adhesive tape 150" can be prevented from being displaced in the width direction in the printer 1 taking up the printed adhesive tape 150" sequentially into a roll shape (=forming the printed adhesive tape roll R2) on the outer circumference portion of the core 41 after the separation material layer 151 is peeled off, so as to form the printed adhesive tape roll R2 in the correct form. In this embodiment, even if a displacement in the width direction of the above described printed adhesive tape 150" or a protrusion of the adhesive from the roll side surface of the printed adhesive tape roll R2 described above may otherwise occur due to a large tension, the correction can be made to the second voltage command value that makes the drive torque of the second motor M2 smaller as compared to the first voltage command value, thereby preventing the displacement in the width direction of the above described printed adhesive tape 150" and the protrusion of the adhesive from the roll side surface of the printed adhesive tape roll R2 described above so as to form the printed adhesive tape roll R2 in the correct form.

The present disclosure is not limited to the above described embodiment and may variously be modified without departing from the spirit and the technical ideas thereof. Such modification examples will hereinafter be described.

(1) Simplified Setting Mode of Correction Amount

In the above described embodiment, the first voltage command value is corrected by using the correction amount corresponding to a combination of all of the tape width, the outer diameter of the core 41, the tape type, and the take-up tape length; however, this is not a limitation. In particular, the correction amount may be set in accordance with one or more selected from tape width, the outer diameter of the core 41, the tape type, and the take-up tape length such that at least the tape width is included.

For example, FIG. 14 shows an example of the correction amount table indicative of a correction amount corresponding to a combination of the tape width and the outer diameter of the core 41. In the example shown in FIG. 14, the tape width is classified into three types as is the case with FIG. 10 described above while the outer diameter of the core 41 is classified into two types as is the case with FIG. 10 described above, and the correction amount of the first voltage command value is determined in accordance with the combination of the tape width and the outer diameter of the core 41.

Alternatively, for example, FIG. 15 shows an example of the correction amount table indicative of a correction amount corresponding only to the tape width. In the example shown in FIG. 15, the tape width is classified into three types as is the case with FIG. 10, and the correction amount of the first voltage command value is determined only in accordance with the tape width.

According to this modification example, the first voltage command value can be corrected in accordance with at least the tape width to prevent a displacement in the width direction of the printed adhesive tape 150" or a protrusion of the adhesive from the roll side surface of the printed adhesive tape roll R2 as is the case with the above described embodiment.

(2) Calculation of Correction Amount without Using Correction Amount Table

The correction amount may be calculated in calculation using a predefined calculation formula parameter instead of referring to the correction amount table to extract the correction amount as in the above described embodiment and the modification example of (1).

FIG. 16 shows an example of a correction amount calculation technique based on calculation using a calculation formula parameter.

In the example shown in FIG. 16, a value of a predetermined calculation formula parameter (hereinafter also simply referred to as "parameter") is quantitatively correlated with each of the above described "tape width," "take-up tape length," "tape type," and "outer diameter of the core 41 (described as "core outer diameter" in FIG. 16)."

In particular, the tape width of 15 [mm] is correlated with a parameter Δ45[%]; the tape width of 38 [mm] is correlated with a parameter Δ15[%]; and the tape width of 50 [mm] is correlated with a parameter Δ10[%].

The take-up tape length is correlated with a value of "current take-up tape length×0.5" used as a parameter.

The tape type of the OPP material (described as "OPP" in FIG. 16) is correlated with a parameter 0[%]; the tape type of the PET material (described as "PET" in FIG. 16) is correlated with a parameter 0[%]; the tape type of the fabric material (described as "FAB" in FIG. 16) is correlated with a parameter Δ5[%].

The outer diameter of the core 41 of 75 [mm] is correlated with a parameter 0[%]; the outer diameter of the core 41 of 30 [mm] is correlated with a parameter Δ10[%].

When the correction amount of the first voltage command value is obtained, the parameter value of "take-up tape length" is subtracted from the parameter value of "tape width," and the parameter values of "tape type" and "outer diameter of the core 41" are added for the calculation. The shown example includes the tape width of 15 [mm] (correlated with the parameter value of Δ45[%]), the take-up tape length of 20 [m] (correlated with the parameter value of 20×0.5), the tape type of the fabric material (correlated with the parameter value of Δ5[%]), and the outer diameter of the core 41 of 30 [mm] (correlated with the parameter value of Δ10[%]) and, as a result, the correction amount of Δ45−(20×0.5)+Δ5+Δ10=Δ50[%] is finally obtained.

The technique of this modification example provides the same effects as the above described embodiment.

(3) Correction with Ambient Temperature Taken into Account

The first voltage command value may be corrected in accordance with the ambient temperature around the printer 1 in addition to the above described tape width, the outer diameter of the core 41, the tape type, and the take-up tape length.

For example, if an ambient temperature is relatively high, since a mechanical load is reduced during operation and the torque added to the above described printed adhesive tape 150" is increased, the tension of the printed adhesive tape 150" becomes large and, therefore, the displacement in the width direction of the above described printed adhesive tape 150" and the protrusion of the adhesive from the roll side surface of the printed adhesive tape roll R2 tend to occur.

In this modification example, the CPU 212 is connected to an ambient temperature sensor detecting the ambient temperature around the printer 1 although not shown, and the ROM 214 stores the correction amount table indicative of a correction amount of the first voltage command value corresponding to a combination of the above described tape width, the outer diameter of the core 41, the tape type, the take-up tape length, and the ambient temperature.

The CPU 212 refers to the above described correction amount table to extract a correction amount in accordance with a combination of the acquired tape width information, the acquired outer diameter information of the core 41, the acquired tape type information, the acquired take-up tape length information, and information on ambient temperature (ambient temperature information) acquired from the above described ambient temperature sensor, and uses the extracted correction amount to correct the first voltage command value to the second voltage command value.

According to this modification example, the CPU 212 corrects the first voltage command value to the second voltage command value with the ambient temperature taken into account. Therefore, the displacement in the width direction of the above described printed adhesive tape 150" and the protrusion of the adhesive from the roll side surface of the printed adhesive tape roll R2 can more reliably be prevented from occurring.

In the above described example, the first voltage command value is corrected by using the correction amount corresponding to a combination of all of the tape width, the outer diameter of the core 41, the tape type, the take-up tape length, and the ambient temperature; however, the correction amount may be set in accordance with one or more selected from the tape width, the outer diameter of the core 41, the tape type, and the take-up tape length such that at least the tape remaining amount is included, and the ambient temperature (or may be calculated based on calculation as in the above described modification example of (2)).

(4) When Tension of Printed Adhesive Tape Becomes Small

Although the present disclosure has been described by taking as an example the case that the tension of the printed adhesive tape 150" becomes large, this is not a limitation and, conversely, the tension of the printed adhesive tape 150" may become small.

For example, if the tape width is relatively wide, the printed adhesive tape 150" wound into a roll shape is in close contact with itself in a large area and, therefore, the tension of the printed adhesive tape 150" easily becomes excessively small. If the outer diameter of the core 41 is relatively large, a tension applied to the printed adhesive tape 150" easily becomes excessively small when the printed adhesive tape 150" is taken up by the above described core 41 under the constant torque control. For example, if the tape type is of relatively large friction coefficient such as resin, the tension of the printed adhesive tape 150" easily becomes excessively small. For example, if the take-up tape length is relatively long, the overall outer diameter of the printed adhesive tape roll R2 is relatively large and the tension applied to the printed adhesive tape 150" easily becomes excessively small as described above under the constant torque control. For example, if the ambient temperature is relatively low, since a mechanical load is increased during operation and the torque added to the above described printed adhesive tape 150" is reduced, the tension of the printed adhesive tape 150" easily becomes small.

Figure 17A:
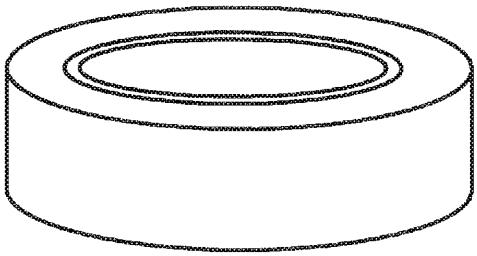
FIG. 17A is an explanatory view of a form of a printed adhesive tape roll when tension is small in a modification example associated with smaller tension of the printed adhesive tape roll.
Figure 17B:
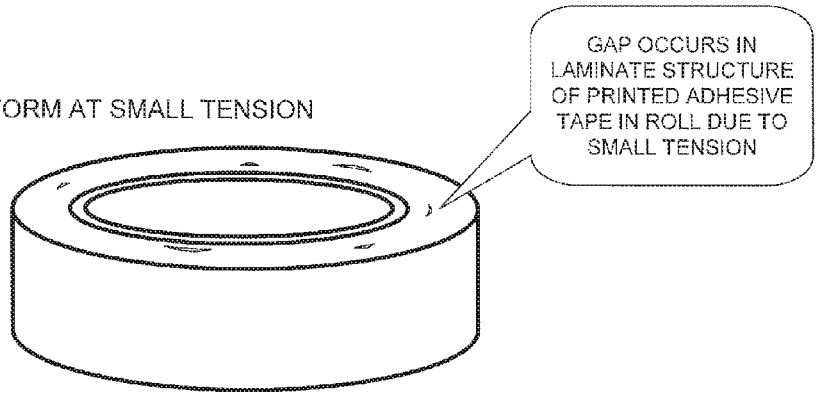
FIG. 17B is an explanatory view of a form of a printed adhesive tape roll when tension is small in a modification example associated with smaller tension of the printed adhesive tape roll.
Figure 17C:
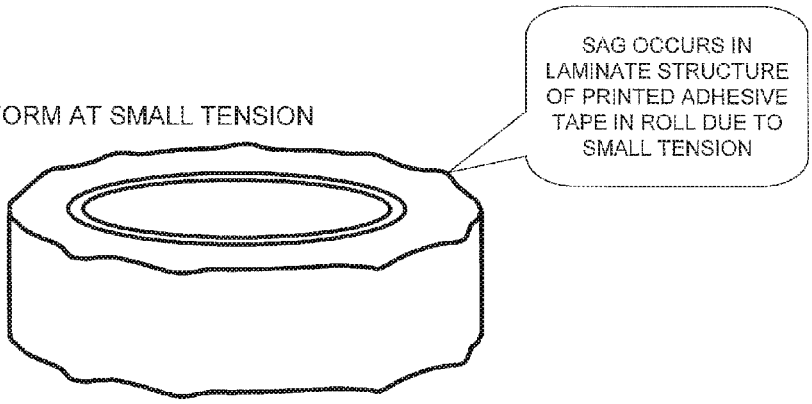
FIG. 17C is an explanatory view of a form of a printed adhesive tape roll when tension is small in a modification example associated with smaller tension of the printed adhesive tape roll.

In these cases, since the tension of the printed adhesive tape 150" becomes small, as shown in FIGS. 17A, 17B, and 17C for comparison, a gap occurs in a laminate structure of the printed adhesive tape 150" in the printed adhesive tape roll R2 (see FIG. 17B) as compared to the intended roll form (see FIG. 17A), resulting in a so-called floating tape (gapping), or a sag occurs in the above described laminate structure (see FIG. 17C), resulting in a so-called gear-shaped roll deformation.

In this modification example, to deal with the possibility of the tension of the printed adhesive tape 150" becoming small as described above due to the above described reasons during provision of the constant torque control using the first voltage command value described above, the CPU 212 corrects the value of the voltage command value Vref output to the motor drive circuit 219 from the first voltage command value to the second voltage command value making the drive torque of the second motor M2 larger as compared to the first voltage command value with the same technique as the above described embodiment etc. In this case, the CPU 212 makes the correction such that as the above described take-up tape length becomes longer, the second voltage command value becomes larger (in other words, the correction amount of the first voltage command value becomes larger). The CPU 212 outputs the above described second voltage command value after the correction (larger than the above described first voltage command value) to the motor drive circuit 219, and the motor drive circuit 219 provides the constant torque control such that the drive torque of the second motor M2 is set to a constant value corresponding to the input second voltage command value.

According to this modification example, the tension can be prevented from becoming small even if the tension of the printed adhesive tape 150" may otherwise become small as described above. As a result, a gap and a sag in the printed adhesive tape roll R2 can be prevented that may occur due to a smaller tension of the printed adhesive tape 150" and the printed adhesive tape roll R2 can be formed in the correct form.

(5) Others

Although the present disclosure has been described by taking as an example the case that the CPU 212 corrects the value of the voltage command value Vref output to the motor drive circuit 219 to correct the drive torque of the second motor M2 from the first drive torque to the second drive torque, this is not a limitation. For example, the CPU 212 may correct a value of a parameter corresponding to the drive torque of the second motor M2 other than the voltage command value Vref output to the motor drive circuit 219, thereby correcting the drive torque of the second motor M2 from the first drive torque to the second drive torque.

It is noted that terms "vertical," "parallel," "plane," etc. in the above description are not used in the exact meanings thereof. Specifically, these terms "vertical," "parallel," and "plane" allow tolerances and errors in design and manufacturing and have meanings of "substantially vertical," "substantially parallel," and "substantially plane."

It is noted that terms "same," "equal," "different," etc. in relation to a dimension and a size of the exterior appearance in the above description are not used in the exact meaning thereof. Specifically, these terms "same," "equal," and "different" allow tolerances and errors in design and manufacturing and have meanings of "substantially the same," "substantially equal," and "substantially different." However, when a value used as a predefined determination criterion or a delimiting value is described such as a threshold value and a reference value, the terms "same," "equal," "different," etc. used for such a description are different from the above definition and have the exact meanings.

The arrows shown in FIGS. 7 and 8 indicate an example of signal flow and are not intended to limit the signal flow directions.

The flowcharts shown in FIGS. 12 and 13 are not intended to limit the present disclosure to the shown procedures and the procedures may be added/deleted or may be executed in different order without departing from the spirit and the technical ideas of the disclosure.

The techniques of the embodiment and the modification examples may appropriately be utilized in combination other than those described above.

What is claimed is:

1. A printer comprising:

a storage part configured to store a print-receiving tape roll with a print-receiving tape wound around an outer circumferential portion of a first core;

a feeding roller;

a printing head disposed facing said feeding roller;

a core driving device; and a controller, said controller being configured to execute:

a feeding process for driving said feeding roller to contact and feed said print-receiving tape fed out from said print-receiving tape roll stored in said storage part, a printing process for controlling said printing head to form a desired print at a desired printing speed on said print-receiving tape fed by said feeding process, thereby forming a printed tape, a taking-up process for driving said core driving device to sequentially take up said printed tape around an outer circumferential portion of a second core into a roll shape, and a torque correction process for correcting a drive torque of said core driving device from a first drive torque determined as standard value in advance to a second drive torque corresponding to a tape width of said print-receiving tape.

2. The printer according to claim 1, wherein in said torque correction process, the drive torque of said core driving device is corrected from said first drive torque to said second drive torque also in accordance with an outer diameter of said second core.

3. The printer according to claim 2, wherein in said torque correction process, the drive torque of said core driving device is corrected from said first drive torque to said second drive torque also in accordance with at least one of a tape type of said print-receiving tape and a length of said printed tape.

4. The printer according to claim 3, wherein in said torque correction process, the drive torque of said core driving device is dynamically corrected to a plurality of values defined as said second drive torque in accordance with a length of said printed tape increasing when said second core sequentially takes up said printed tape.

5. The printer according to claim 3, further comprising a constant torque control device configured to perform constant torque control of setting the drive torque of said core driving device to a constant value corresponding to an input command value, wherein said torque correction process is a command value correction process for correcting said command value output to said constant torque control device from a first command value corresponding to said first drive torque to a second command value corresponding to said second drive torque.

6. The printer according to claim 5, wherein in said command value correction process, said first command value is corrected to said second command value in accordance with all of said tape width, the outer diameter of said second core, said tape type, and the length of said printed tape.

7. The printer according to claim 5, further comprising a memory configured to store a correction amount table indicative of a correction amount corresponding to a combination of said tape width, the outer diameter of said second core, said tape type, and the length of said printed tape, wherein in said command value correction process, said first command value is corrected to said second command value by reference to said correction amount table stored in said memory.

8. The printer according to claim 5, wherein in said command value correction process, said first command value is corrected to said second command value also in accordance with an ambient temperature.

9. The printer according to claim 1, further comprising a cutter configured to cut said printed tape taken up by said second core to produce one roll-shaped printed matter.

10. The printer according to claim 1, wherein said print-receiving tape roll is a roll of adhesive print-receiving tape acquired by winding an adhesive print-receiving tape as said print-receiving tape including a base layer, an adhesive layer for affixing said base layer to an adherend, and a separation material layer covering said adhesive layer, and in said taking-up process, after said separation material layer is peeled off from a printed adhesive tape that is said printed tape fed by said feeding roller and having said print formed by said printing head, said printed adhesive tape is taken up around the outer circumferential portion of said second core.

11. A printer comprising:

a first storage part configured to store a print-receiving tape roll with a print-receiving tape wound around an outer circumferential portion of a first core;

a second storage part configured to store a second core;

a feeding roller;

a printing head;

a memory configured to store a value of a tape width of said print-receiving tape, a value of a tape type of said print-receiving tape, a value of an outer diameter of said second core, and a value of a take-up tape length of said print-receiving tape around said second core and to store a predetermined calculation formula related to said tape width, said tape type, said outer diameter, and said take-up tape length;

a first motor configured to drive said feeding roller;

a first motor drive circuit configured to drive said first motor;

a second motor configured to drive said second core;

a second motor drive circuit configured to drive said second motor and to make a drive torque of said second motor constant in accordance with an input voltage value; and a controller, said controller being configured to:

control said first motor drive circuit to drive said first motor for driving said feeding roller to feed said print-receiving tape of said print-receiving tape roll, the print-receiving tape being rewound from said first core, control said printing head to print on said print-receiving tape, and control said second motor drive circuit to drive said second motor for driving said second core to wind said print-receiving tape after printing around said second core, said controller inputting a voltage value represented by voltage value=reference voltage valuex{(100+correction amount)/100} to said second motor drive circuit to control a torque of said second motor, and said correction amount is calculated by said calculation formula represented by correction amount=tape width parameter−take-up tape length parameter+tape type parameter+outer diameter parameter by using a tape width parameter, a take-up tape length parameter, a tape type parameter, and an outer diameter parameter correlated with the value of said tape width, the value of said take-up tape length, the value of said tape type, and the value of said outer diameter, respectively.

12. The printer according to claim 11, wherein said take-up tape length parameter is a value acquired by multiplying a latest value of the take-up tape length of said print-receiving tape around said second core by 0.5.

13. The printer according to claim 11, wherein said first core is disposed in a tape cartridge having a third core, said print-receiving tape includes a separation material layer, said printer further comprises:

a third storage part configured to store said third core;

a third motor configured to drive said third core; and a third motor drive circuit configured to drive said third motor, said first storage part is configured to store said print-receiving tape roll of said tape cartridge, said third storage part is configured to store said third core of said tape cartridge, and wherein said controller is configured to further control said third motor drive circuit to drive said third motor for rotating said third core to wind around said third core said separation material layer peeled off from said print-receiving tape.

14. The printer according to claim 11, wherein said print-receiving tape includes:

a base layer, an adhesive layer for affixing said base layer to an adherend, and a separation material layer covering said adhesive layer, said controller is configured to further control said second motor drive circuit to drive said second motor for driving said second core to take up around said second core a printed adhesive tape acquired by peeling off said separation material layer from said print-receiving tape after said printing.

* * * * *